US011220397B2

(12) United States Patent
Lamb et al.

(10) Patent No.: US 11,220,397 B2
(45) Date of Patent: Jan. 11, 2022

(54) CONTAINER FOR PREPARATION OF A BEVERAGE AND MACHINE FOR AUTOMATED FILLING OF THE CONTAINER

(71) Applicant: PNEUTOOLS, INC., Arlington, TN (US)

(72) Inventors: Frederick William Lamb, McDonald, PA (US); Frederick William Lamb, II, Cecil, PA (US); James F. F. Clark, Baden, PA (US)

(73) Assignee: PNEUTOOLS, INC., Arlington, TN (US)

( * ) Notice: Subject to any disclaimer, the term of this patent is extended or adjusted under 35 U.S.C. 154(b) by 280 days.

(21) Appl. No.: 16/663,680

(22) Filed: Oct. 25, 2019

(65) Prior Publication Data

US 2020/0055667 A1 Feb. 20, 2020

Related U.S. Application Data

(62) Division of application No. 15/234,301, filed on Aug. 11, 2016, now Pat. No. 10,486,896.

(60) Provisional application No. 62/203,570, filed on Aug. 11, 2015.

(51) Int. Cl.

| | |
|---|---|
| ***B65D 85/804*** | (2006.01) |
| ***B65B 43/60*** | (2006.01) |
| ***B65B 7/28*** | (2006.01) |
| ***B65B 43/50*** | (2006.01) |
| ***B65B 7/16*** | (2006.01) |
| ***B65B 29/02*** | (2006.01) |

(52) U.S. Cl.

CPC ..... *B65D 85/8043* (2013.01); *B65B 7/167* (2013.01); *B65B 7/2878* (2013.01); *B65B 29/022* (2017.08); *B65B 43/50* (2013.01); *B65B 43/60* (2013.01)

(58) Field of Classification Search

CPC ..... A47J 31/08; B65B 29/02; B65B 29/022; B65B 29/025; B65D 85/8043; B65D 85/8046

USPC ..... 99/295; 426/433

See application file for complete search history.

(56) References Cited

U.S. PATENT DOCUMENTS

| | | | |
|---|---|---|---|
| 2,778,739 | A | 1/1957 | Rodth |
| 3,283,469 | A | 11/1966 | McBrady et al. |
| 3,908,340 | A | 9/1975 | Erhardt |

(Continued)

FOREIGN PATENT DOCUMENTS

| | | |
|---|---|---|
| GB | 2491445 | 12/2012 |
| WO | 2013060918 | 5/2013 |

*Primary Examiner* — Eyamindae C Jallow

(74) *Attorney, Agent, or Firm* — Reed Smith LLP

(57) ABSTRACT

A container for the preparation of a beverage and a machine for the filling of containers for the preparation of the beverage. The container includes an outer cup, an inner cup nesting inside the outer cup, and a filter disposed between a sidewall of the outer cup and a sidewall of the inner cup and covering a bottom opening of the inner cup. The machine includes a first zone configured to dispense a container from a stack of containers, a second zone configured to fill the container with a beverage substrate, a third zone configured to seal the container and dispense a filled container, and a carriage configured to transport the container between the first and second zones, and between the second and third zones.

8 Claims, 34 Drawing Sheets

(56) References Cited

U.S. PATENT DOCUMENTS

| | | | | |
|---|---|---|---|---|
| 4,024,694 | A | 5/1977 | Cooper et al. | |
| 5,325,765 | A | 7/1994 | Sylvan | |
| 6,305,149 | B1 | 10/2001 | Gorlich et al. | |
| 6,646,537 | B1 | 1/2003 | Sweeney | |
| 6,523,328 | B1 | 2/2003 | De Cardenas | |
| 6,810,788 | B2 | 11/2004 | Hale | |
| 7,591,218 | B2 | 9/2009 | Bunn | |
| 8,361,527 | B2 * | 1/2013 | Winkler | A47J 31/3695 426/79 |
| 8,474,368 | B2 * | 7/2013 | Kilber | B65D 85/8043 99/295 |
| D698,649 | S | 2/2014 | Quint | |
| D715,649 | S | 10/2014 | O'Brien | |
| 8,906,440 | B2 * | 12/2014 | Otto | A47J 31/0626 426/433 |
| 9,150,347 | B2 * | 10/2015 | Scheiber | B65D 85/8043 |
| 9,216,854 | B2 * | 12/2015 | Schreiber | B65D 85/8043 |
| 9,725,196 | B2 * | 8/2017 | Bartoli | B65D 85/8043 |
| 9,801,494 | B2 * | 10/2017 | Castellani | A47J 31/407 |
| 10,737,876 | B2 * | 8/2020 | Kruger | B65D 85/8043 |
| 11,000,148 | B2 * | 5/2021 | Conant | B65D 1/265 |
| 2006/0236871 | A1 | 10/2006 | Ternite | |
| 2007/0148290 | A1 | 6/2007 | Ternite | |
| 2011/0064852 | A1 | 3/2011 | Mann | |
| 2011/0097450 | A1 | 4/2011 | Kruger | |
| 2011/0259205 | A1 | 10/2011 | Delorme | |
| 2012/0070551 | A1 * | 3/2012 | Mahlich | A23F 5/26 426/433 |
| 2012/0097602 | A1 * | 4/2012 | Tedford | B65D 65/466 210/500.1 |
| 2013/0251861 | A1 | 9/2013 | Scapuccin | |
| 2013/0327223 | A1 | 12/2013 | Bartoli | |
| 2014/0017359 | A1 | 1/2014 | Kruger | |
| 2014/0072676 | A1 | 3/2014 | Moutty | |
| 2014/0120217 | A1 | 5/2014 | O'Brien | |
| 2014/0272018 | A1 | 9/2014 | Koller | |
| 2015/0056341 | A1 * | 2/2015 | Trombetta | B65B 7/2878 426/115 |
| 2017/0275085 | A1 * | 9/2017 | Rapparini | B65B 7/28 |

* cited by examiner

CONTAINER FOR PREPARATION OF A BEVERAGE AND MACHINE FOR AUTOMATED FILLING OF THE CONTAINER

CROSS-REFERENCE TO RELATED APPLICATION

This application is a divisional of U.S. patent application Ser. No. 15/234,301 filed on Aug. 11, 2016; which claims the benefit under 35 U.S.C. § 119(e) of the earlier filing date of U.S. Provisional Patent Application No. 62/203,570 filed on Aug. 11, 2015, the disclosures of which are incorporated by reference herein.

BACKGROUND

This application discloses an invention which is related, generally and in various embodiments, to the field of containers for preparation of beverages, especially coffee and tea and to machines for automated filling of the containers.

The popularity of the single beverage server such as those sold under the trademark KEURIG continues to rise. In general, single beverage servers typically use a single serving pod, cartridge or container having a premeasured amount of a beverage substrate such as ground coffee or tea to which hot water is added. A typical brewing cartridge is a plastic container with a filter inside. A beverage substrate is packed in the typical brewing cartridge inside a paper filter and sealed with a foil lid. A typical single beverage server brews coffee or tea by piercing the foil seal on top of the plastic container with a spray nozzle, while piercing the bottom of the container with a discharge nozzle. Hot water is forced through the container, passing through the beverage substrate and through the filter. Typical single beverage containers have been criticized for the difficulty of recycling the containers and for the impact the disposable plastic containers have on the environment.

Although convenient, typical disposable single serving containers may be less desirable in some situations due to increased cost and lack of the ability to customize the type or strength of the beverage. For example, because the single serving containers are prepackaged, the selection of beverage substrates is limited. As a result, a user may not be able to use his/her favorite beverage substrate when utilizing a prepackaged single serving container. Similarly, because the single serving containers are prepackaged, varying the strength of the resultant beverage may be difficult.

Reusable single serving containers tend to be tedious due to the nature of pouring beverage substrates such as coffee grounds in a small container. Also, reusable single serving containers require cleaning that disposable single serving containers do not. As such, there is a desirability for single serving containers composed of recyclable materials and present container designs do not facilitate this.

BRIEF DESCRIPTION OF THE DRAWINGS

Various embodiments of the invention are described herein in by way of example in conjunction with the following figures, wherein like reference characters designate the same or similar elements.

FIG. 15 shows an open front view of the machine in a sixth operating position of the third zone.

DETAILED DESCRIPTION

Figure 1:
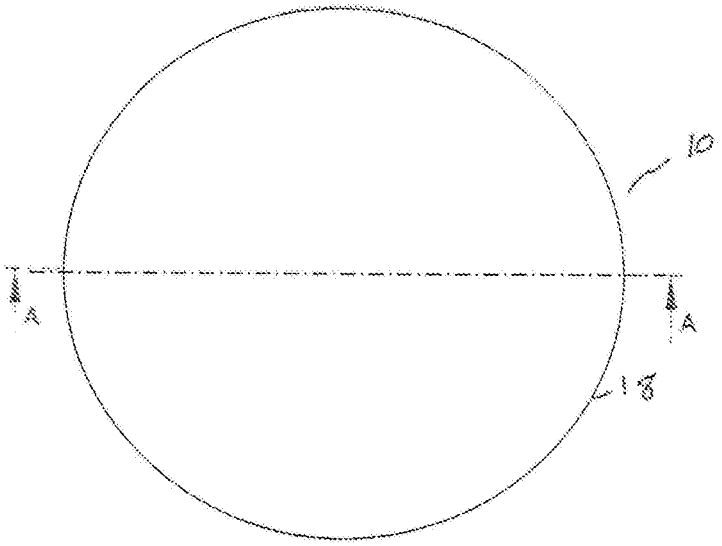
FIG. 1 shows a top view of a container for preparation of a beverage according to embodiments of the invention.
Figure 2:
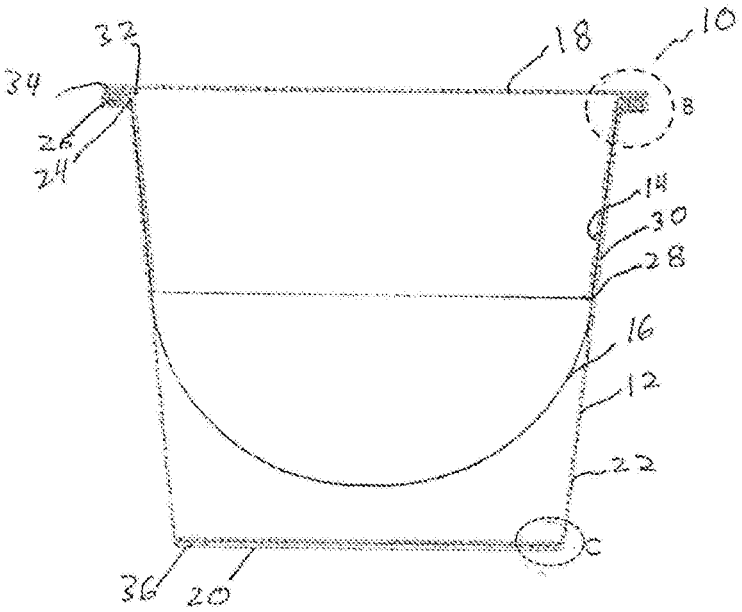
FIG. 2 shows a cross-sectional view of a container through line A-A of FIG. 1.
Figure 3A:
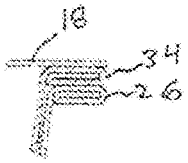
FIG. 3A shows a detail view of area B of FIG. 2.
Figure 3B:
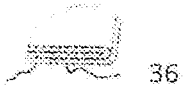
FIG. 3B shows a detail view of area C of FIG. 2.
Figure 4:
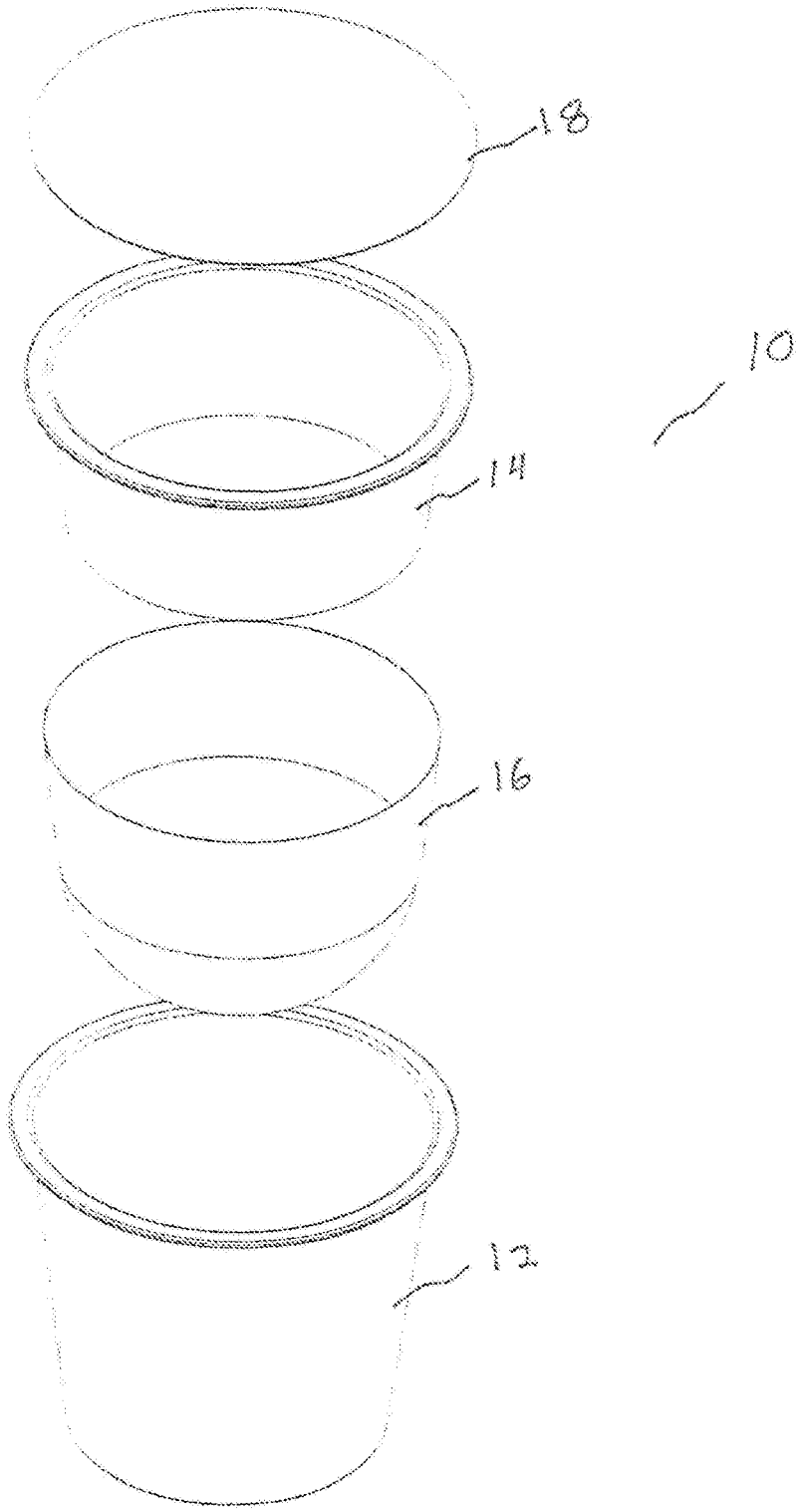
FIG. 4 shows an exploded view of the container of FIG. 1.
Figure 5:
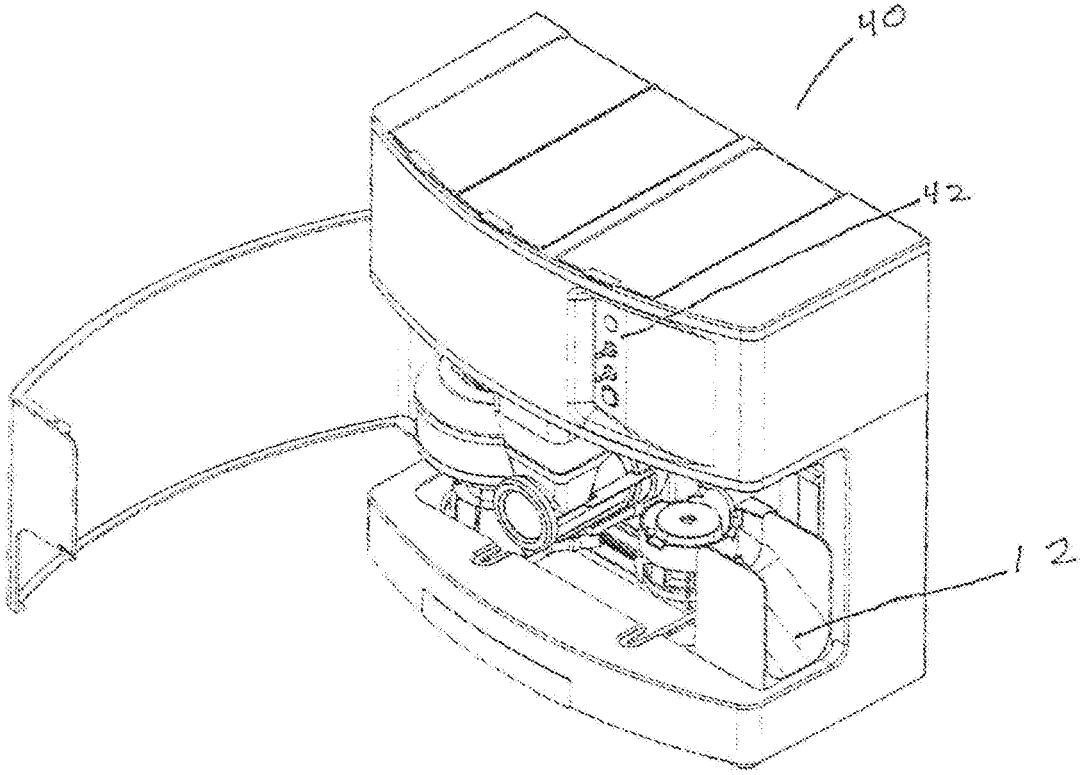
FIG. 5 shows a perspective view of a machine for automated filling of the container according to embodiments of the invention.
Figure 6:
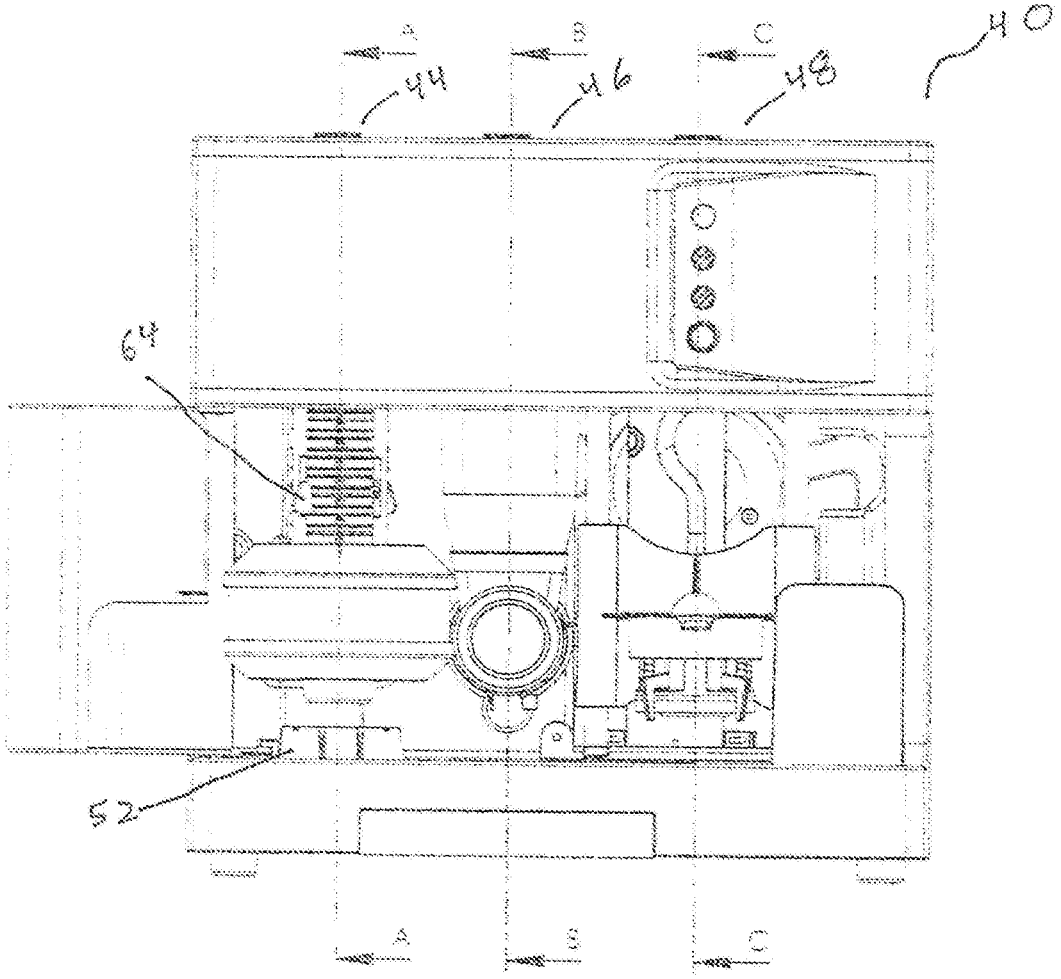
FIG. 6 shows a front view of the machine of FIG. 5.
Figure 7:
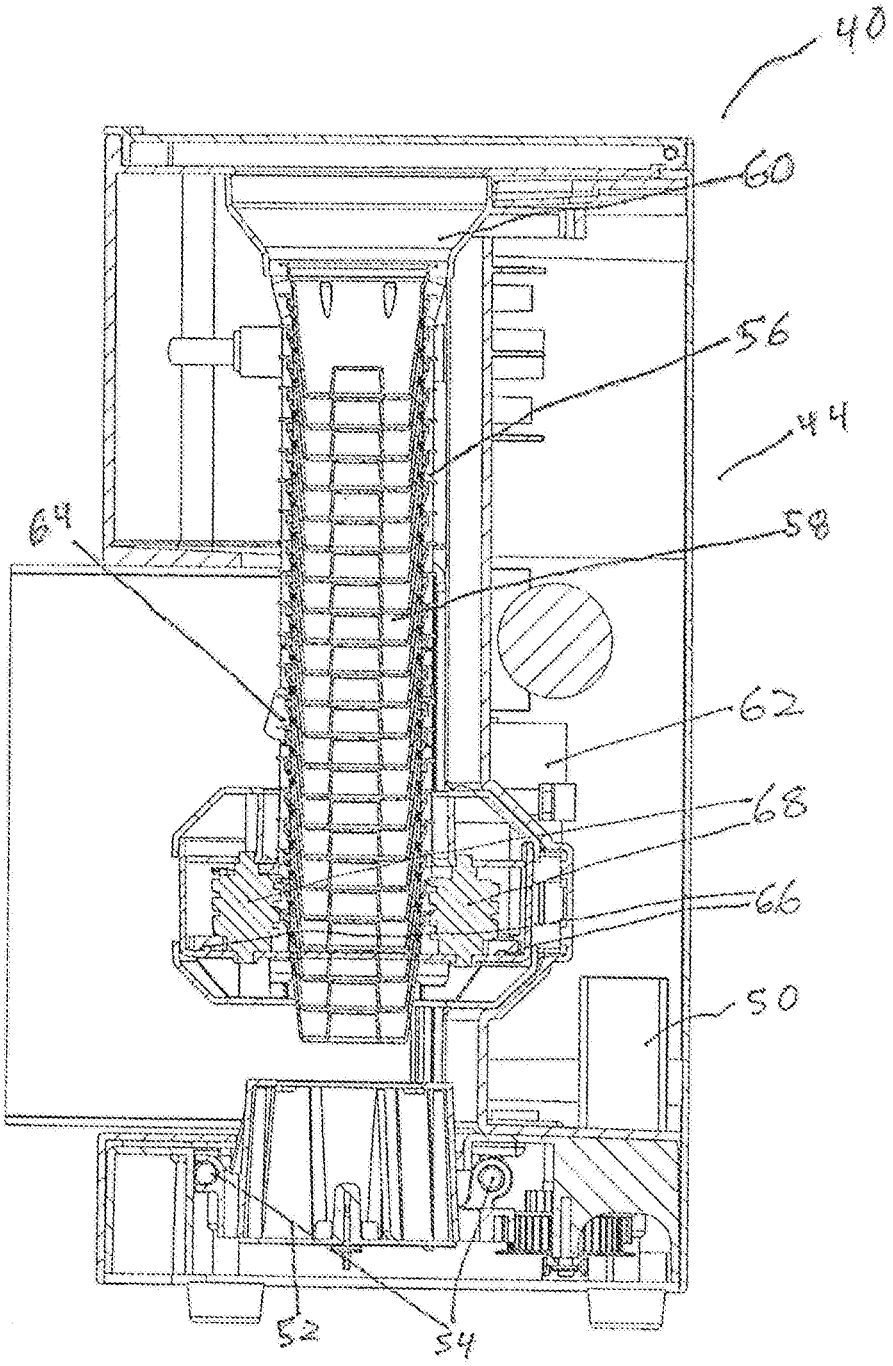
FIG. 7 shows a cross-sectional view of the machine through line A-A of FIG. 6.

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

Embodiments of the present application address the above-described shortcomings by providing a container for preparation of a beverage and a machine for automated filling of the container by a user. As used herein, the term container is synonymous with cartridges, cups, capsules, pods, and the like, that may be used in the preparation of a beverage or other food. The term beverage, as used herein is intended to include and not be limited to coffee, tea, and other beverages or foods. The beverage substrates may include but are not limited to ground or freeze dried coffee, tea, herbs, powdered beverage concentrate, or other beverage or food concentrates. For purposes of the description hereinafter, the terms "top," "bottom," "vertical," and "horizontal" and derivatives thereof shall relate to the invention, as it is oriented in the drawing FIGS.

An exemplary embodiment of a container 10 is illustrated in FIGS. 1-4. The container 10 comprises an outer cup 12, an inner cup 14, and a filter 16. A lid 18 is heat sealed onto container 10. Outer cup 12 includes a base 20, frustoconically shaped sidewall 22, and an opening 24 opposite base 20. Sidewall 22 includes a radially outwardly protruding lip 26 surrounding opening 24. Inner cup 14 nests inside and is shorter in height than outer cup 12. Inner cup 14 includes a bottom opening 28, frustoconically shaped sidewall 30, and a top opening 32 opposite bottom opening 28. Sidewall 30 includes a radially outwardly protruding lip 34 surrounding top opening 32. Filter 16 is disposed between sidewall 22 and sidewall 30 and covers bottom opening 28. Base 20 includes a rim 36 around its periphery. Each of lips 26 and 34 is folded-over, and flattened. Lips 26 and 34 are stacked with lip 34 of inner cup 14 on top of lip 26 of outer cup 12. Lips 26 and 34 are then heat sealed together. This sealing creates a durable rim that gives the containers 10 structural integrity. This also allows for a stronger, more sure seal of lid 18 when it is placed and heat sealed on the containers 10. It also helps prevent blowouts around these lips 26 and 34 when the heat and pressure of the beverage is inside of the container 10 during the brewing process. Rim 36 of base 20 of outer cup 12 is also folded over, flattened and heat sealed against base 20. This creates support for base 20, and allows for a better puncture of the material of the container in brewing devices. Doing this also helps prevent base 20 from losing structural integrity during the brewing process, and keeps it from blowing out while it is under the heat and pressure of the beverage being applied to it. Outer cup 12 and inner cup 14 are preferably made from compostable, heat sealable paper. Filter 16 is preferably made from compostable paper. Lid 18 is preferably made from compostable, heat sealable paper or compostable plastic, and is heat sealed to lip 34 of the inner cup and flattened. In addition to other design features of container 10, the double heat sealed lips 26 and 34 and folded over and heat sealed rim 36 of base 20 provides structural integrity which allows the use of compostable, heat sealable stock material. Without these features, compostable, heat sealable stock material would be unsound and unusable in brewing container.

An exemplary embodiment of a machine 40 for automated filling of containers 10 is illustrated in FIGS. 5-24. Machine 40 is for the automated filling of containers 10 with beverage substrate for later use in a single beverage server. Machine 40 is compact and is intended for use by an individual user in, for example, a kitchen or office setting. Machine 40 has machine settings 42, for example, for power, selecting what beverage is being made, for purging substrate, and the quantity of beverage substrate that is put into each container. In the illustrated embodiment, machine settings 42 include a three point switch for selecting "Coffee", "Cocoa", or "Tea" is on the front panel of the machine. The user selects what is being put into the containers 10. Machine settings 42 also include a three point switch for selecting "Light", "Regular", or "Strong" is also on the front panel of the machine. The user selects one of these settings which effects how much beverage substrate ends up in each container. Other settings and switches may also be used.

Machine 40 includes three zones including a first zone 44 for dispensing a container 10 from a stack of containers 58, a second zone 46 for filling the container 10 with a beverage substrate and a third zone 48 for sealing the container 10 with a lid 18 and dispensing a filled container 10. A carriage 52 is disposed beneath the three zones 44, 46 and 48 and has a motor 50 (FIG. 16) for moving carriage 52 in a reciprocating motion on a pair of rails 54 (FIG. 7) in order to transfer a container 10 between the zones 44, 46 and 48.

Figure 17A:
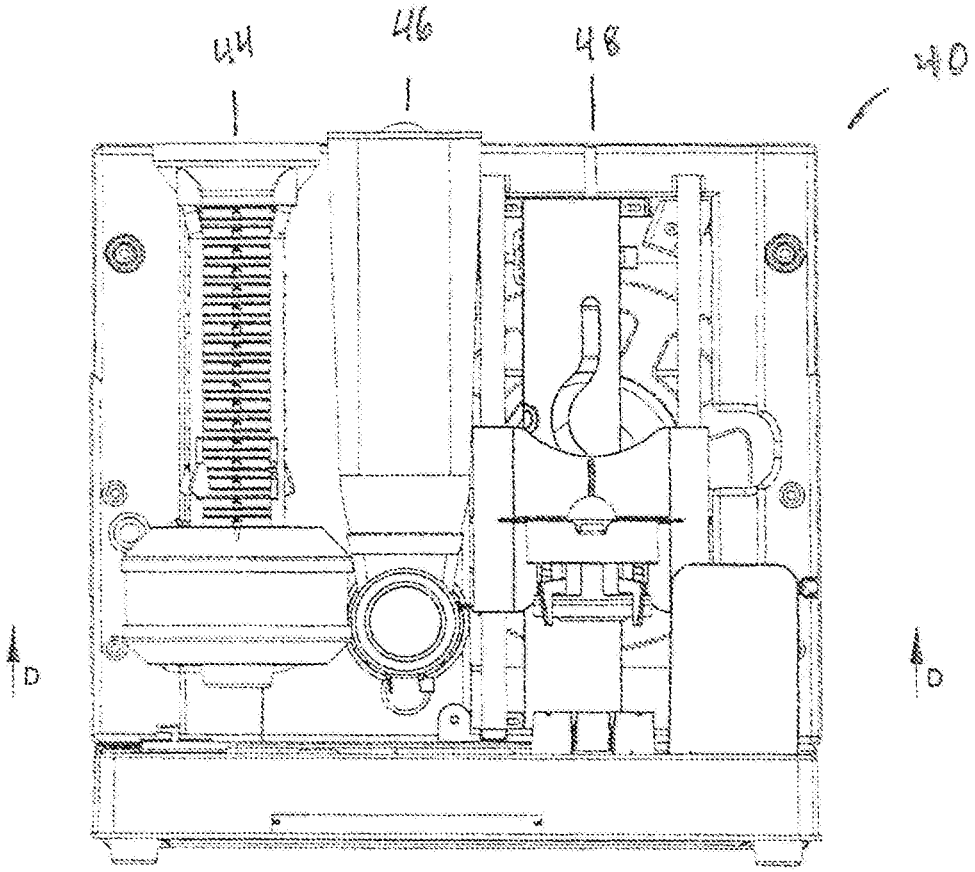
FIG. 17A shows an open front view of the machine.
Figure 17B:
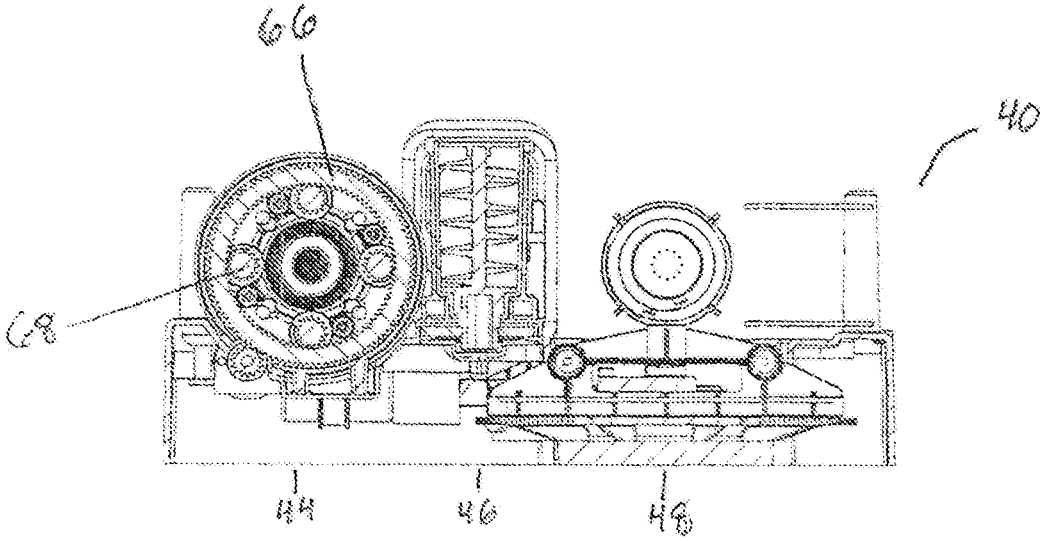
FIG. 17B shows a cross-sectional view through lines D-D of FIG. 17A showing the operating procedure of the first zone's container drop.
Figure 18A:
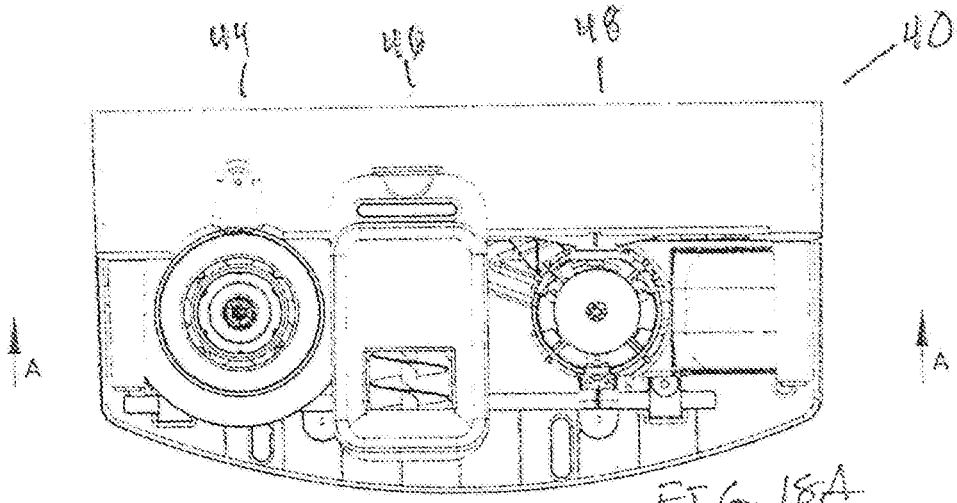
FIG. 18A shows an open top view of the machine.
Figure 18B:
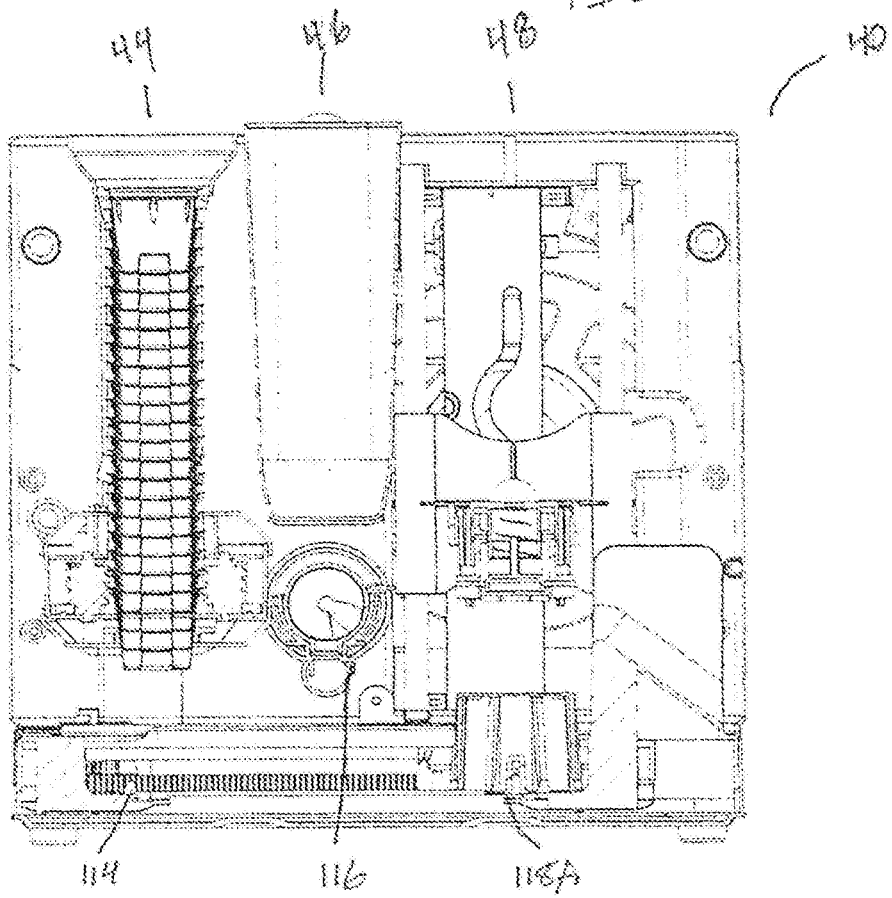
FIG. 18B shows a cross-sectional view through lines A-A of FIG. 18A showing positions of the photo eyes of the first, second, and third zones.

First zone 44 includes a container loading channel 56 for receiving a vertical stack 58 of containers 10. Loading channel 56 has a funnel shaped opening 60 at its upper receiving end. Loading channel 56 further includes fingers 64 configured to keep the stack 58 of containers 10 upright. First zone 44 further includes a ring gear 66 and cylindrical gears 68 surrounding loading channel 56 at its lower dispensing end which dispenses containers 10 one at a time from the stack of containers 58 into carriage 52 which transports the container 10 to second zone 42. First zone 44 includes a motor 62. Referring to FIG. 17B, ring gear 66 has teeth on the outside edge, as well as on the inside edge. Motor 62 has a small gear that meshes with the outside teeth of the ring gear 66. The teeth located on the inside of ring gear 66 mesh with small gear heads on the bottom of cylindrical gears 68. The heat sealed lips 34 and 26, ride in the grooves of the cylindrical gears 68 as motor 62 pulses, before dropping out into the carriage 52 below.

Machine 40 runs preliminary checks to ensure proper running of machine 40. In a first check, the carriage motor 50 brings carriage 52 to it to first zone 44, where it registers off of a first zone micro switch 120. A first zone photo eye 114 under first zone 44 checks for an obstructing container 10 presence. If there is an obstructing container 10, the carriage 52 runs over to third zone 48 and a red Error Notification LED is lit above third zone 48, prompting the user to remove the obstructing container 10. If no container 10 is present, the first zone 44 motor 62 that runs the gears holding the stack 58 of containers 10 will be given a start signal for dropping a container 10.

Once carriage 52 is positioned directly under first zone 44, the motor 62 spinning the ring gear 66 that spins the cylindrical gears 68 begins to pulse. This pulsing moves the containers 10 downward until one container 10 is released from the loading channel 56 and the cylindrical gear 68 holding container 10. As soon as a container 10 has dropped, the first zone photo eye 114 (FIGS. 16 and 18B) beneath first zone 44 senses the change in distance moved by the bottom of the container 10, and stops the first zone 44 motor 62 from pulsing immediately. Once the signal from first zone photo eye 114 has been activated, the motor 50 for carriage 52 turns on, and sends the carriage to second zone 46.

Figure 8:
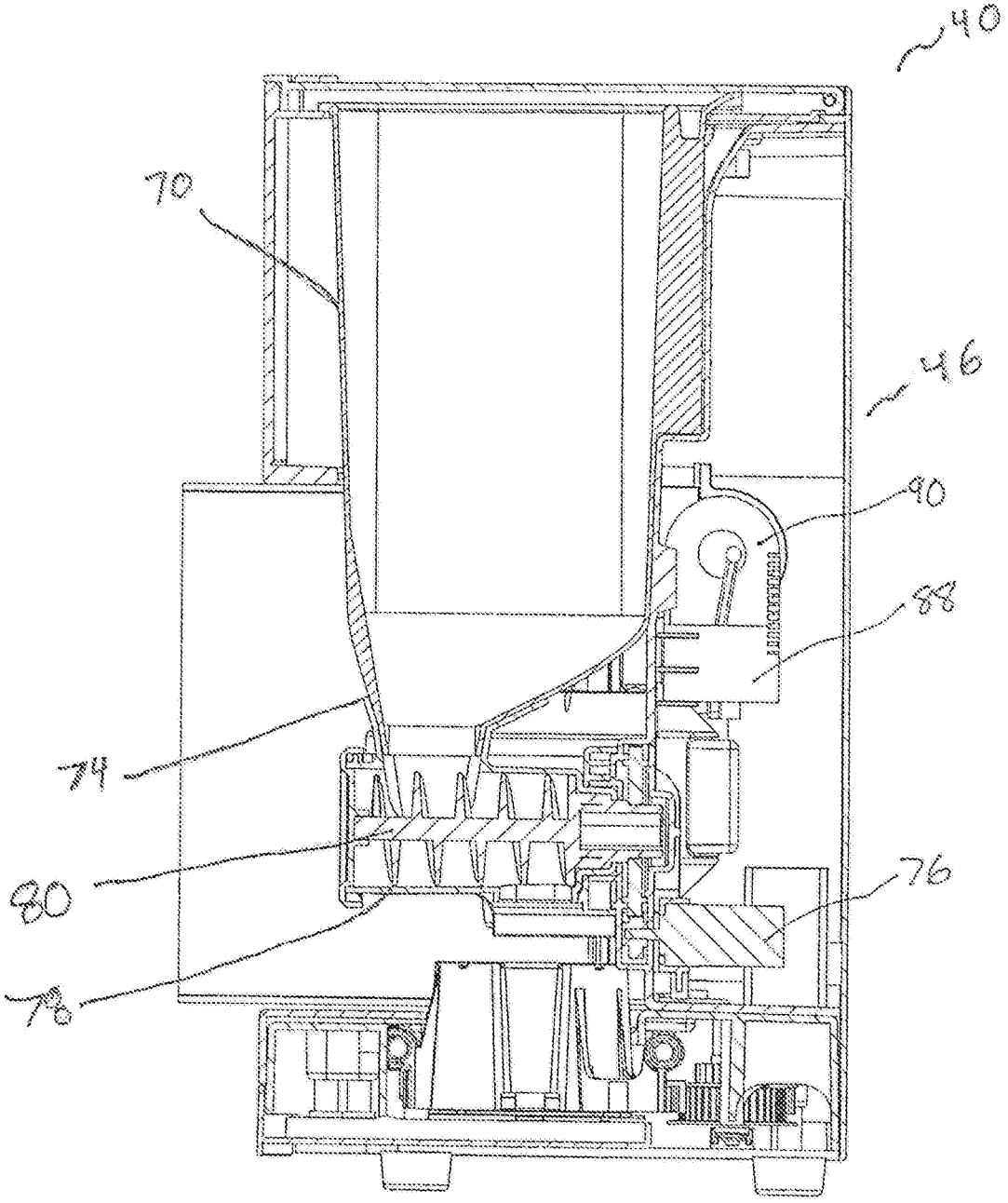
FIG. 8 shows a cross-sectional view of the machine through line B-B of FIG. 6.
Figure 9:
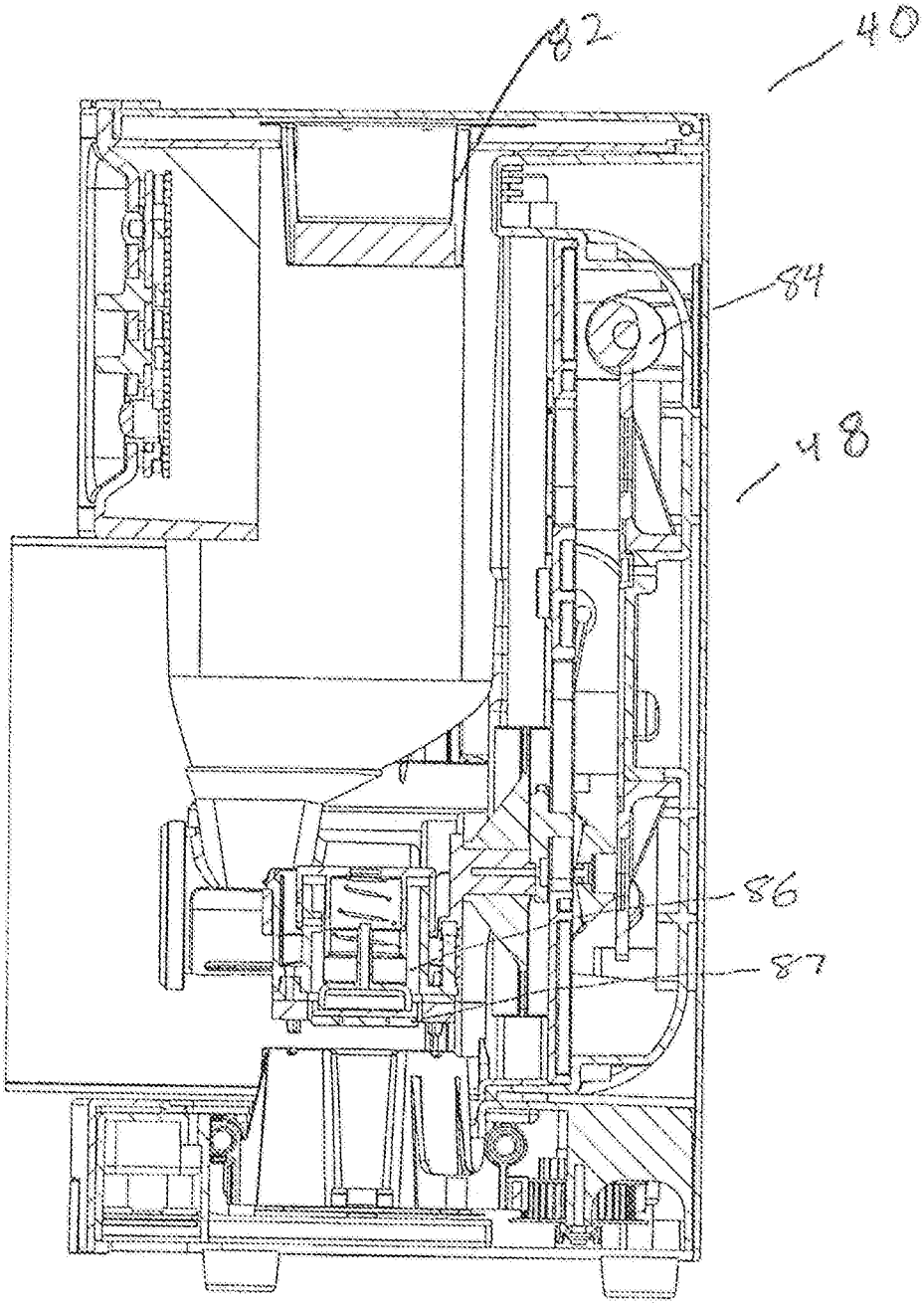
FIG. 9 shows a cross-sectional view of the machine through line C-C of FIG. 6.
Figure 10:
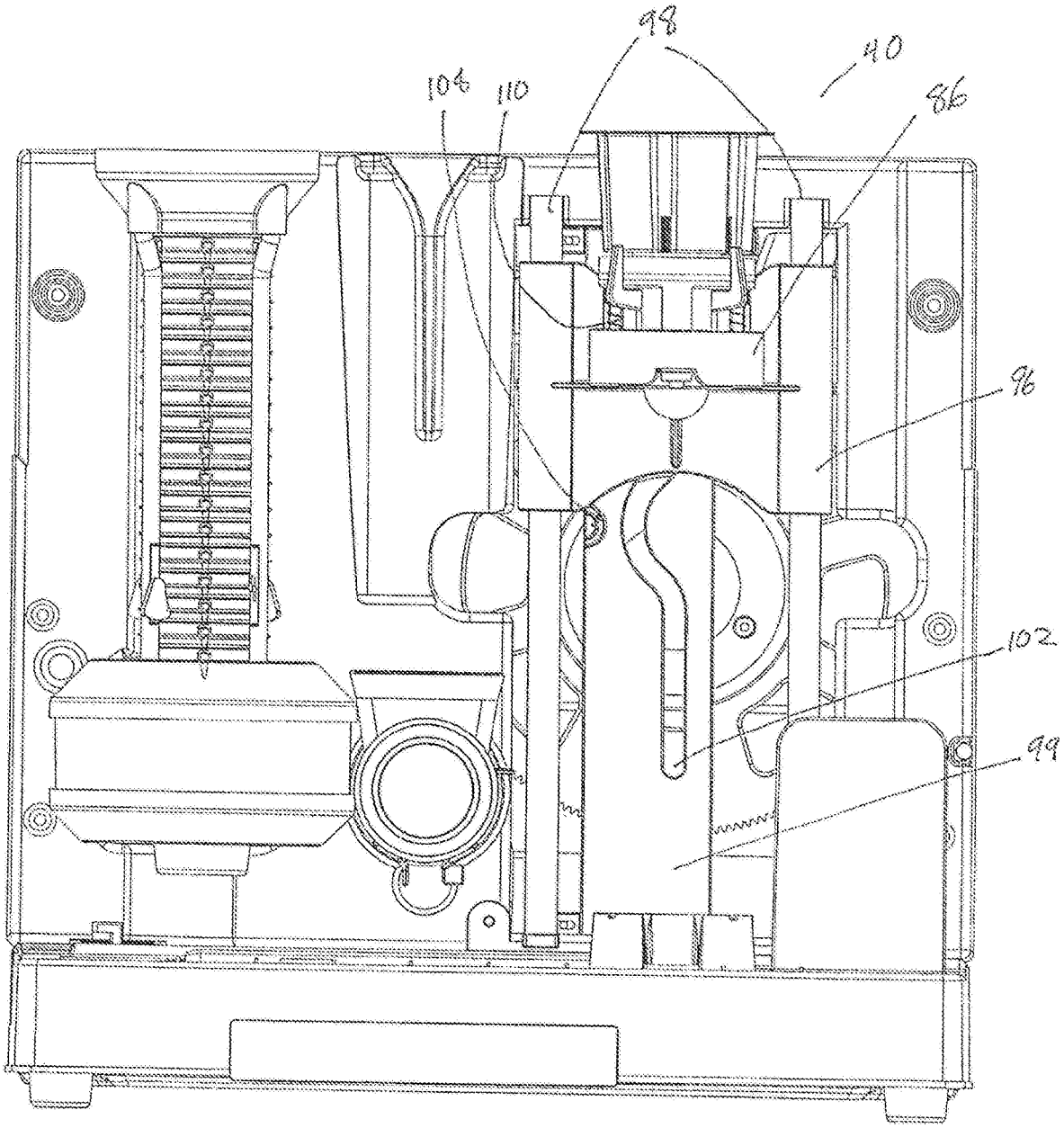
FIG. 10 shows an open front view of the machine in a first operating position of the third zone.

Referring to FIG. 8, second zone 46 includes a beverage substrate hopper 70 having a funnel shaped lower dispensing end 74. An auger housing 78 having an auger 80 is disposed at lower dispensing end 74 for receiving beverage substrate from the beverage substrate hopper 70. Auger 80 propels a selected amount of beverage substrate into a container 10 on carriage 52 upon rotation of auger 80. After filling of the container 10 with the selected amount of beverage substrate carriage 52 transports container 10 to third zone 48. Second zone 46 includes a motor 76 for rotating auger 80.

Once carriage 52 trips a micro switch 122 under second zone 46, the motor 50 for carriage 52 receives a signal to stop, and the motor 76 for second zone 46 that runs auger 80 begins to spin. A time delay is built into the program for the auger's motor 76 to allow for a priming of the auger housing 78. The beverage substrate dispenses at the bottom of the auger housing 78, which has a second zone photo eye 116 (FIG. 18B) housed inside of it. As soon as beverage substrate begins to exit auger housing 78, photo eye 116 picks up the break in its signal, and begins to run an algorithm based on the settings selected earlier. Once the timer in the algorithm reaches its end, it signals the auger motor 76 to stop, thereby stopping the filling of the container 10. At this point it also sends a signal to the carriage motor 50 to turn on, and to send carriage 52 to third zone 48.

Third zone 48 includes a lid dispenser 82 for receiving a stack of lids 18 and dispensing lids 18 one at a time. Third zone 48 further includes a third zone motor 84, a heat seal vacuum head 86 having heating element 87 (FIG. 11), a vacuum pump 88 (FIG. 8) and a vacuum pump motor 90. Third zone 48 further includes a wheel gear 92 having a knob 94 disposed on one side thereof around the periphery of the wheel gear 92, an elevating carriage 96 that is attached to two vertical guide rails 98, and a stationary bracket 99.

Figure 11:
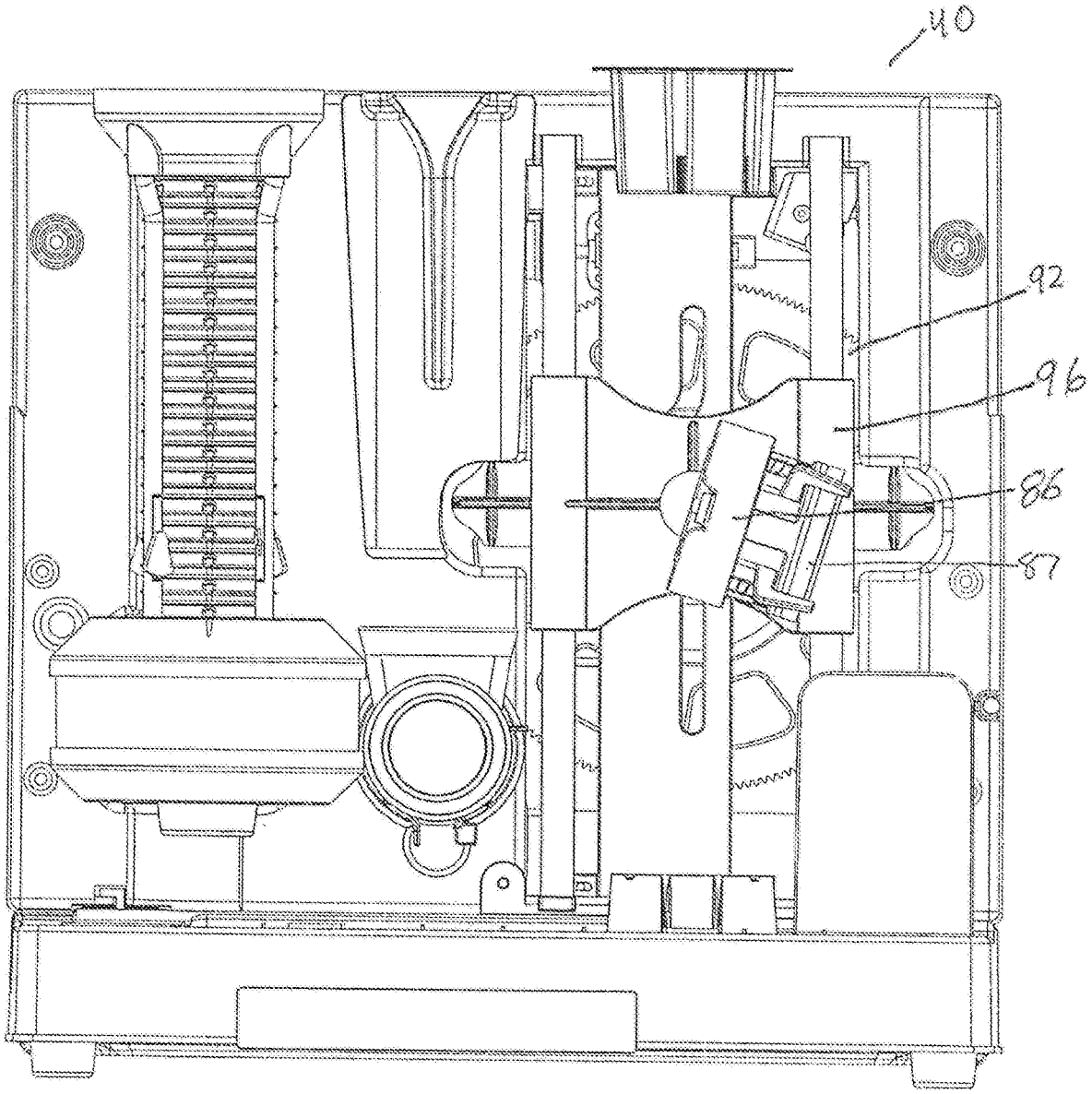
FIG. 11 shows an open front view of the machine in a second operating position of the third zone.
Figure 12:
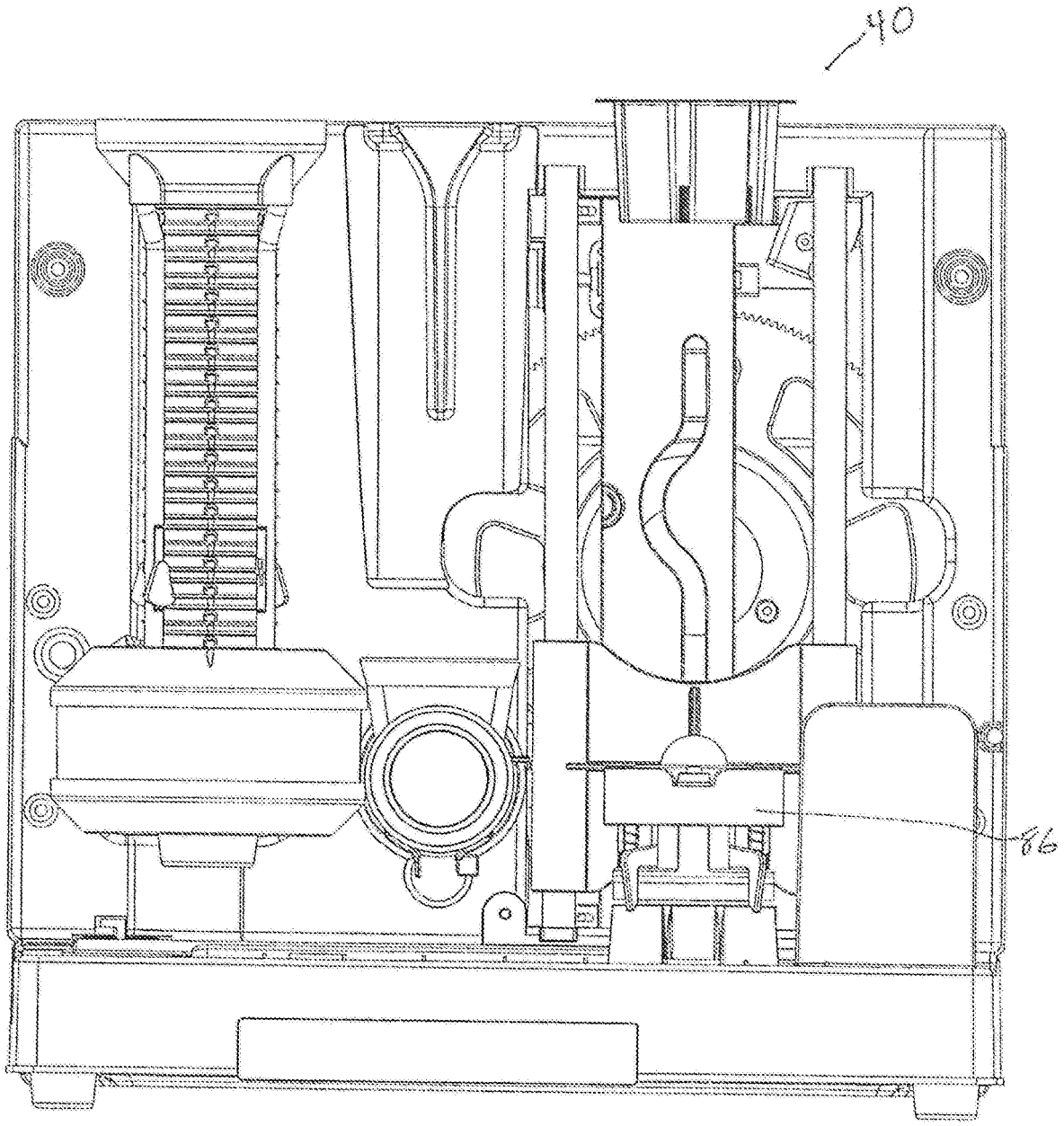
FIG. 12 shows an open front view of the machine in a third operating position of the third zone.
Figure 13:
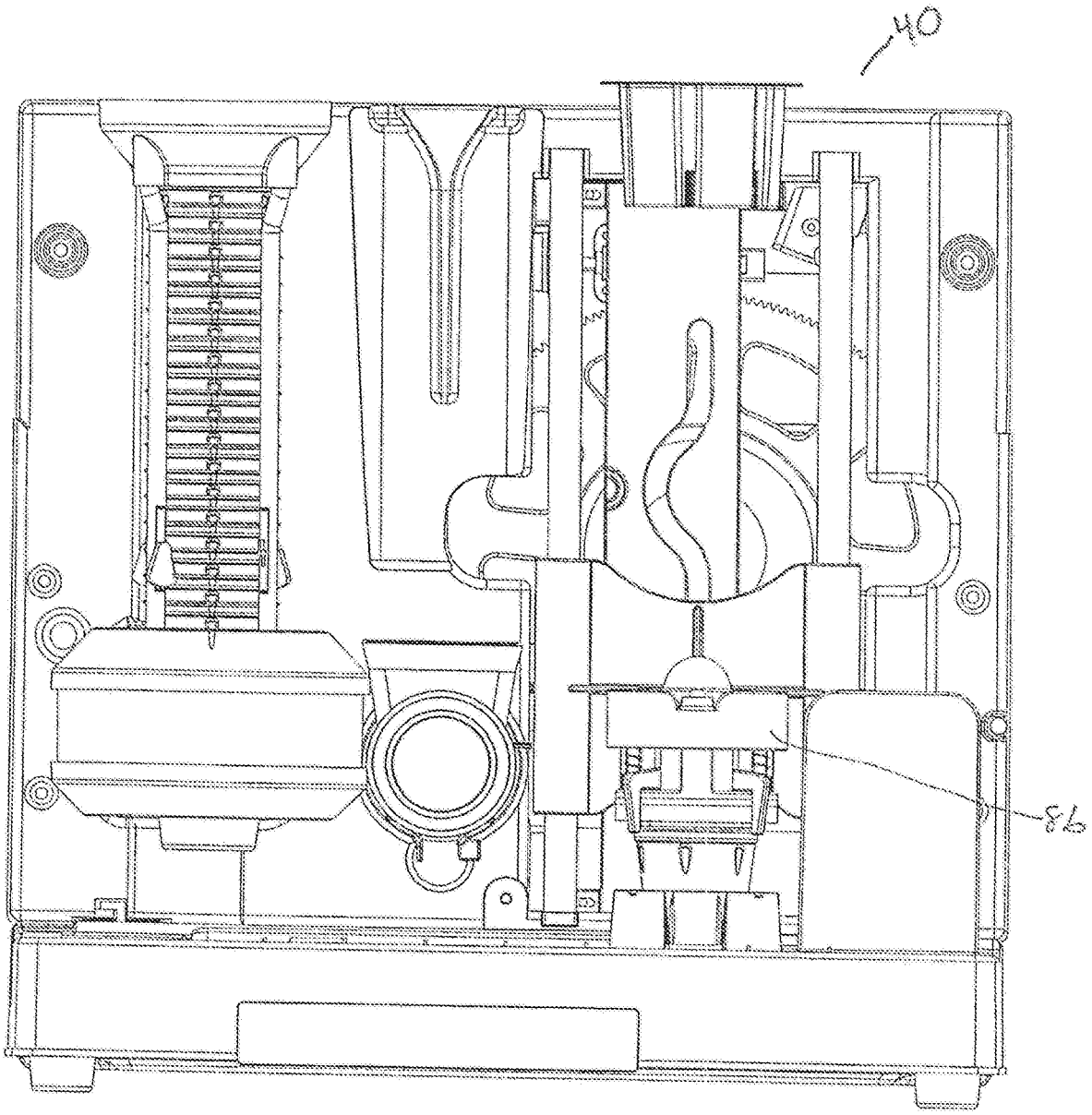
FIG. 13 shows an open front view of the machine in a fourth operating position of the third zone.
Figure 14:
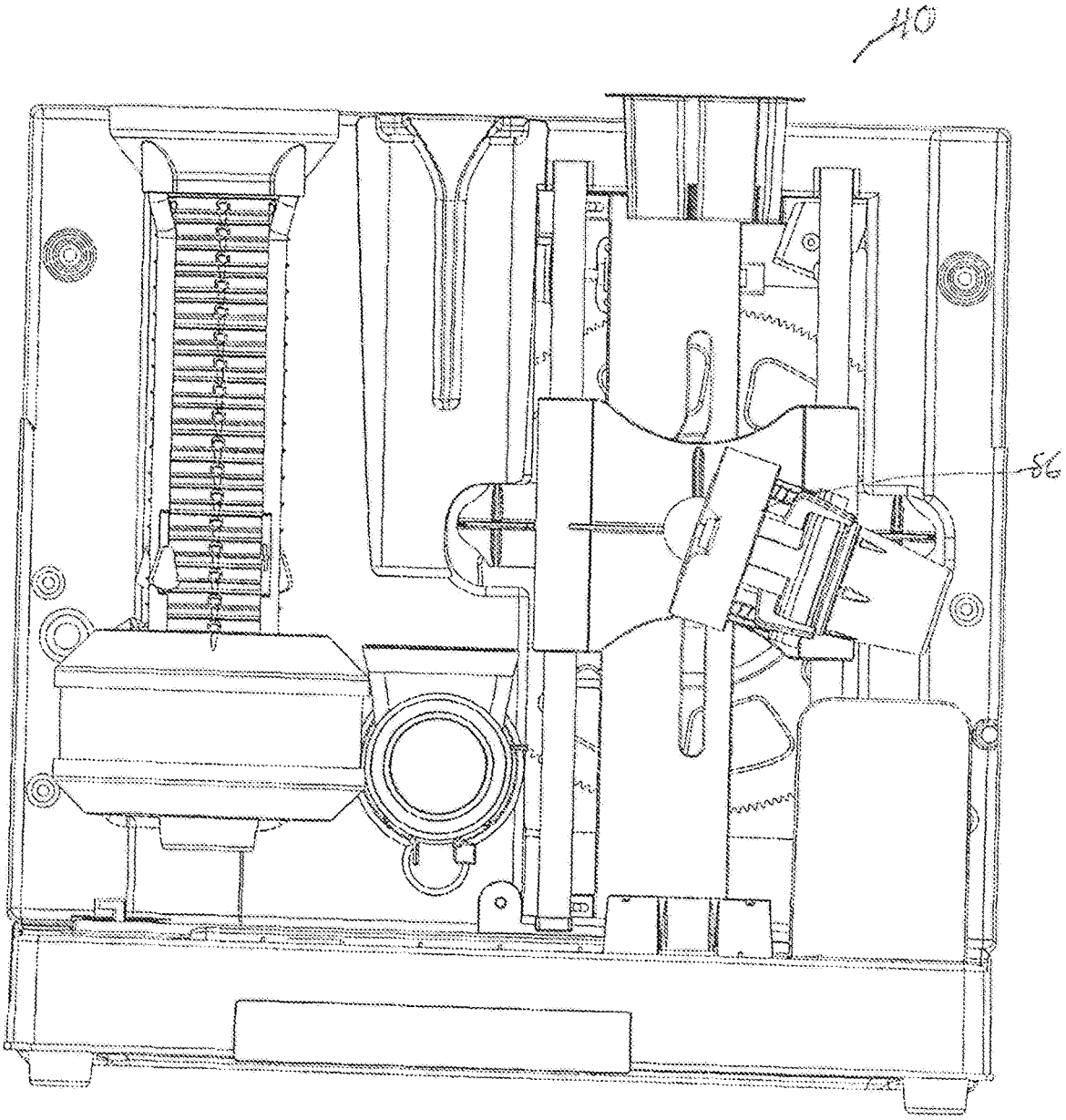
FIG. 14 shows an open front view of the machine in a fifth operating position of the third zone.
Figure 16:
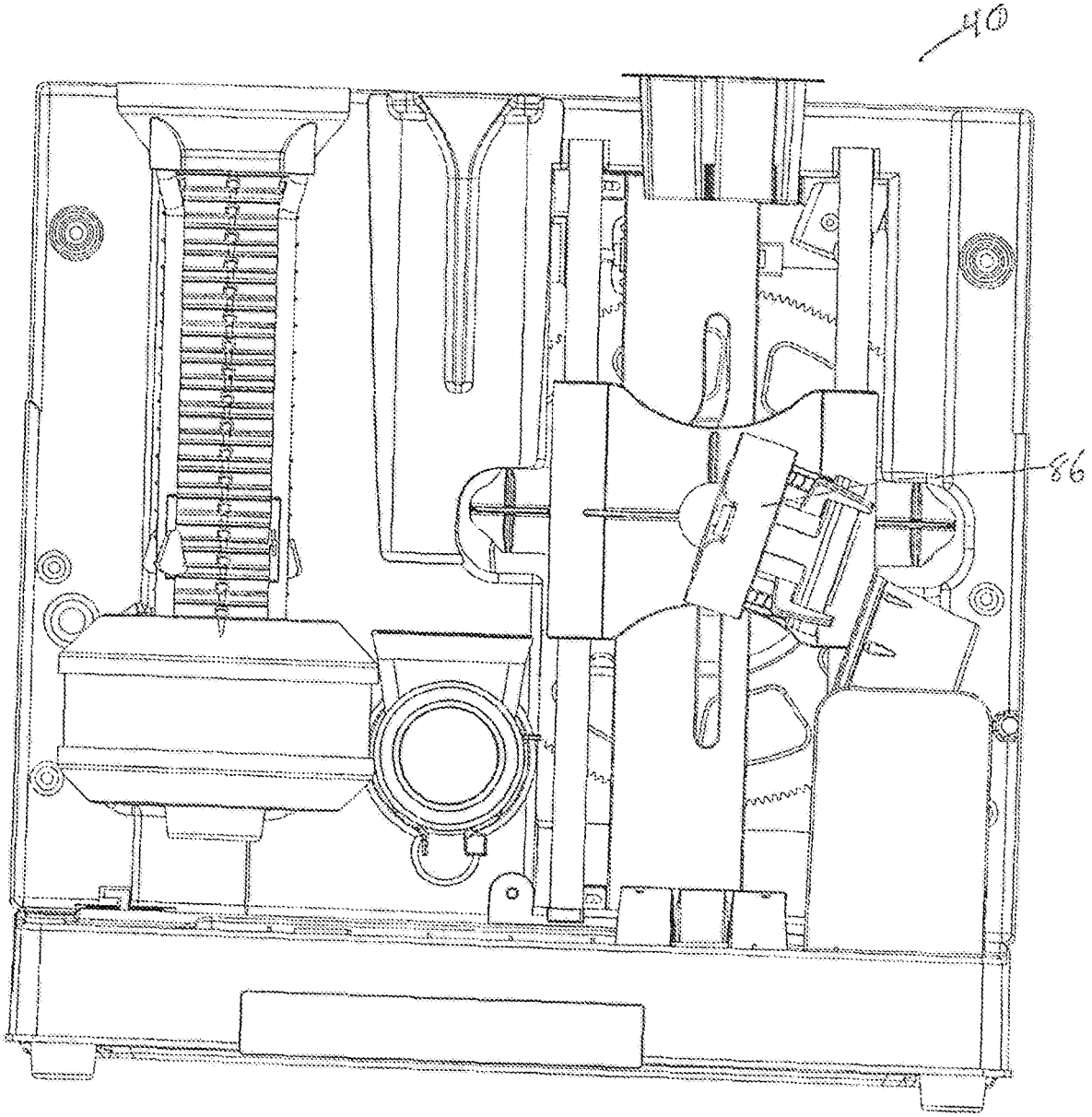
FIG. 16 shows an open back view of the machine, showing the interior of the machine.
Figure 16:
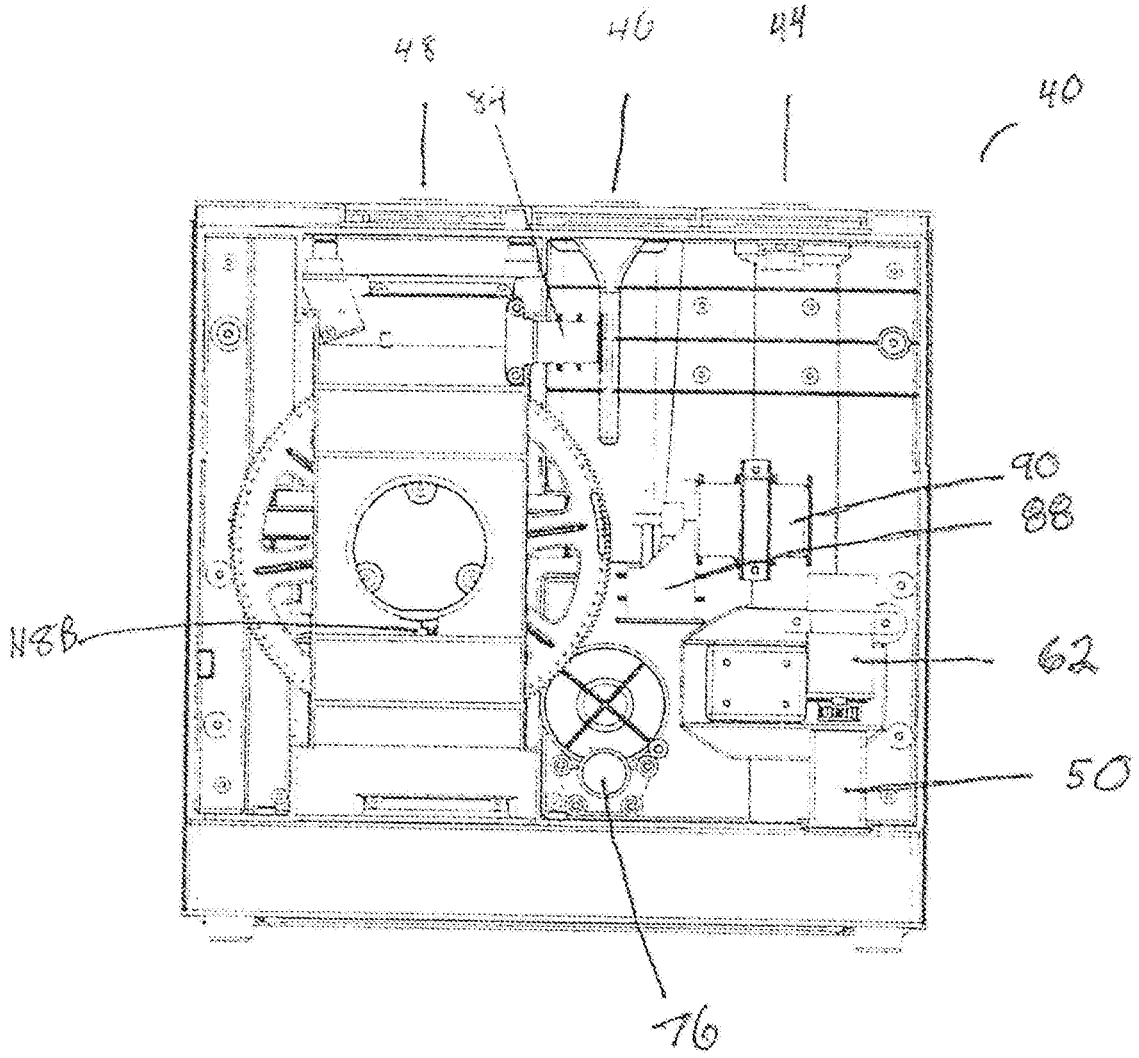
Figure 19:
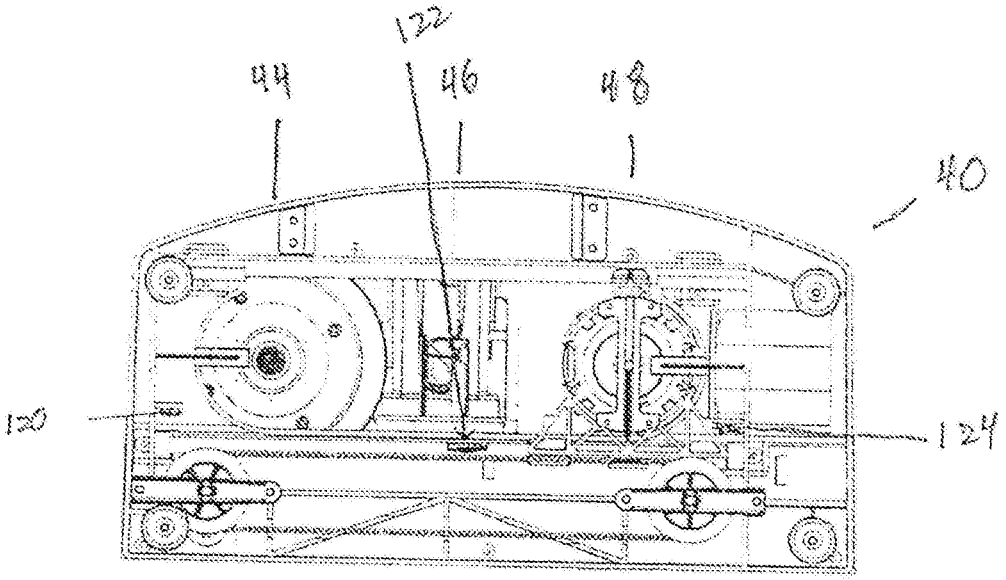
FIG. 19 shows an open bottom view showing first, second, and third zone micro switches.
Figure 20:
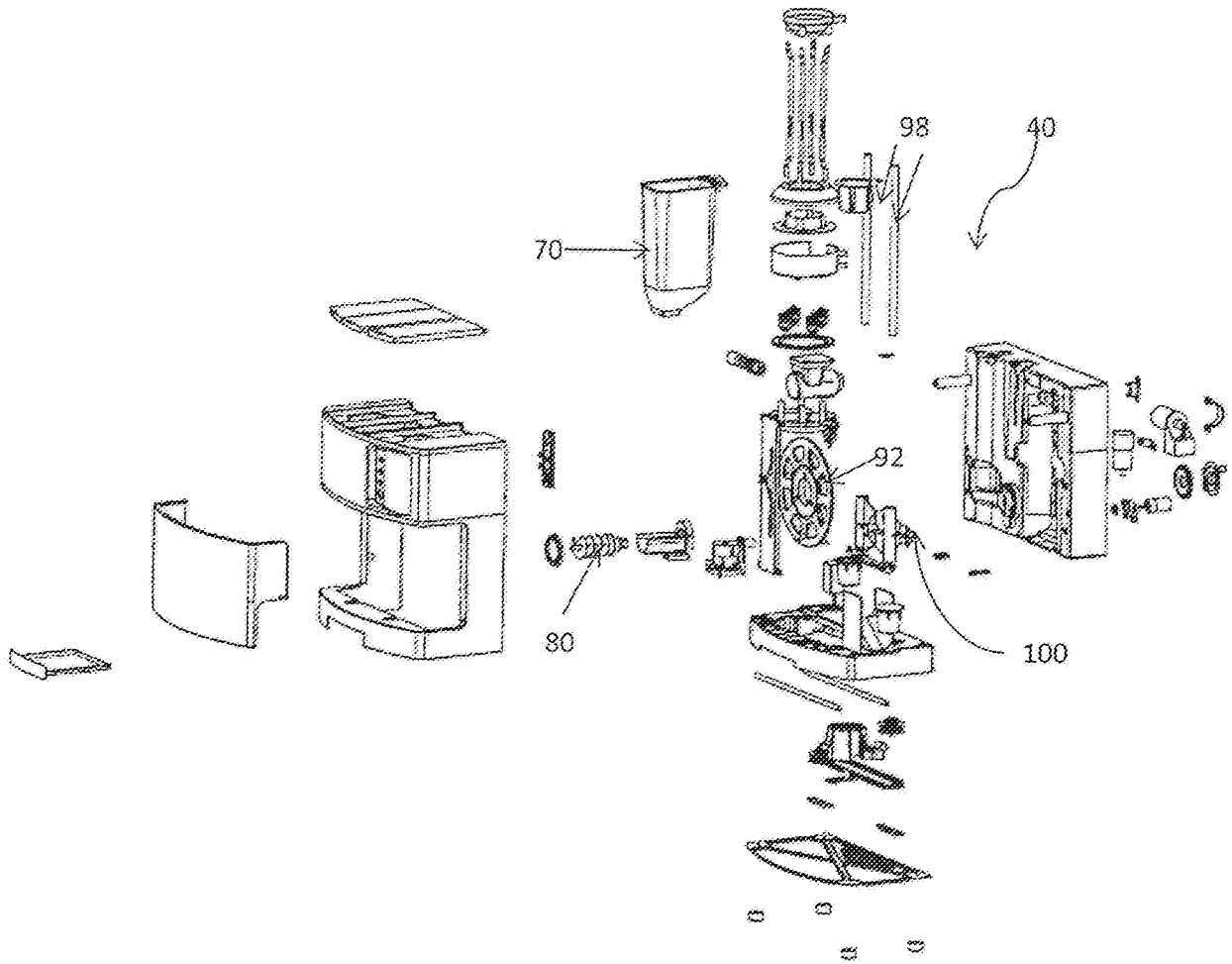
FIG. 20 shows an exploded view of the machine.
Figure 21:
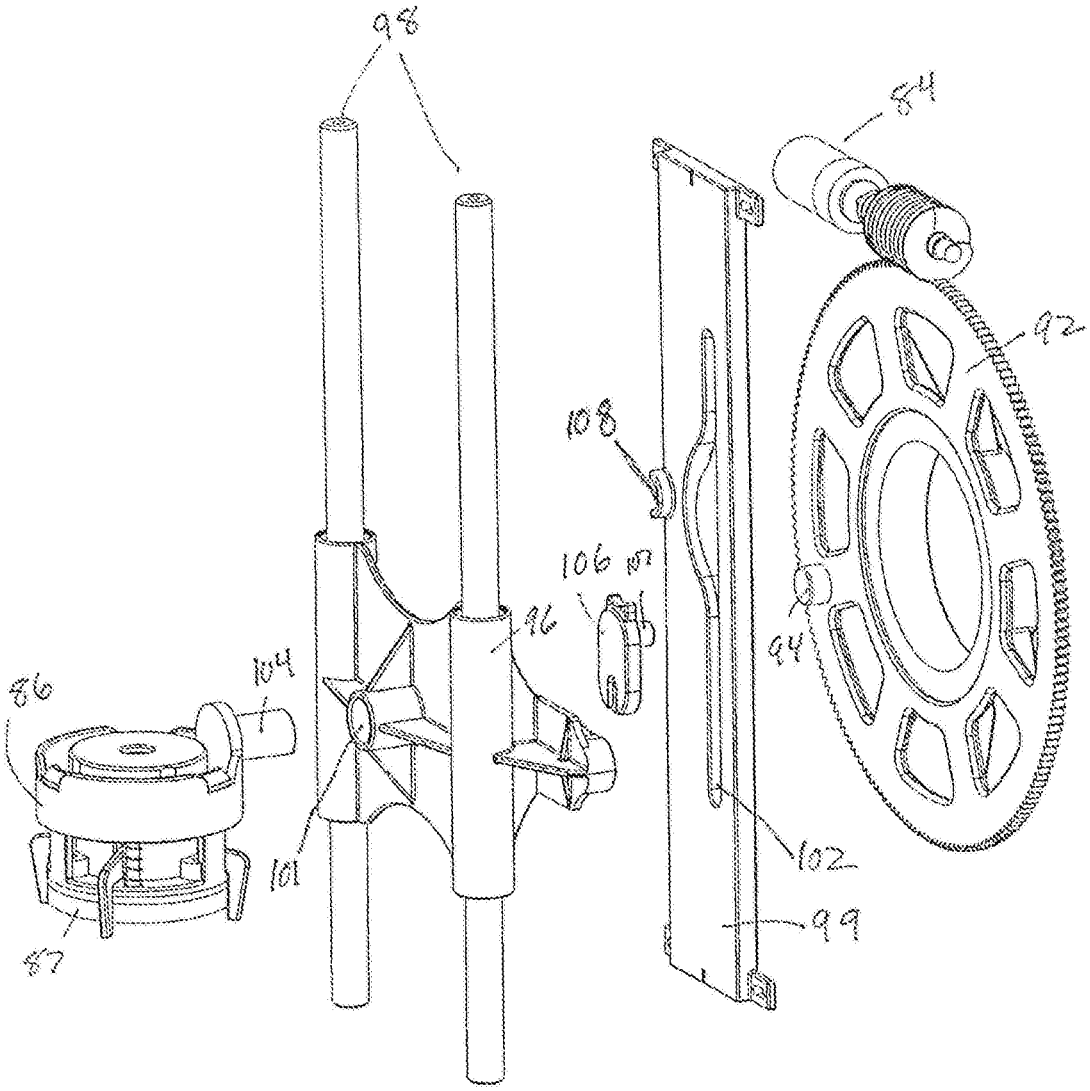
FIG. 21 shows a front perspective exploded view of several third zone components.
Figure 22:
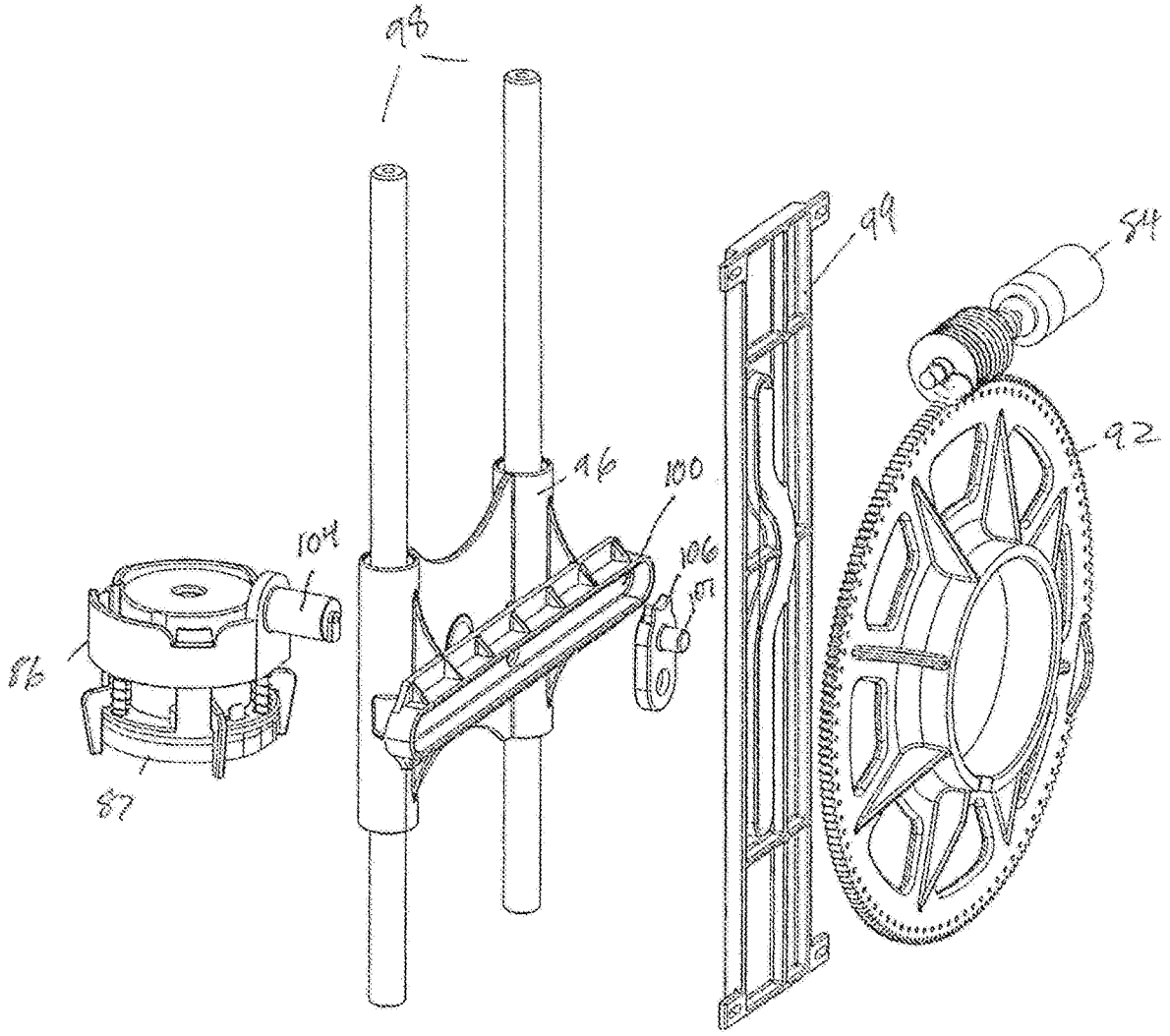
FIG. 22 shows a rear perspective exploded view of several third zone components.
Figure 23:
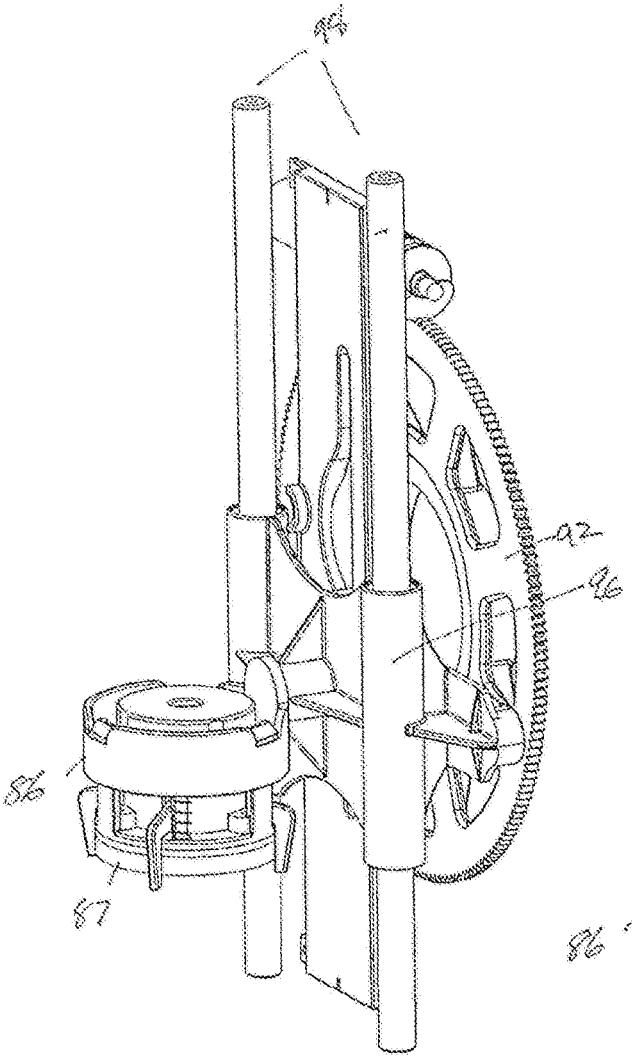
FIG. 23 shows a front perspective view of several third zone components.
Figure 24:
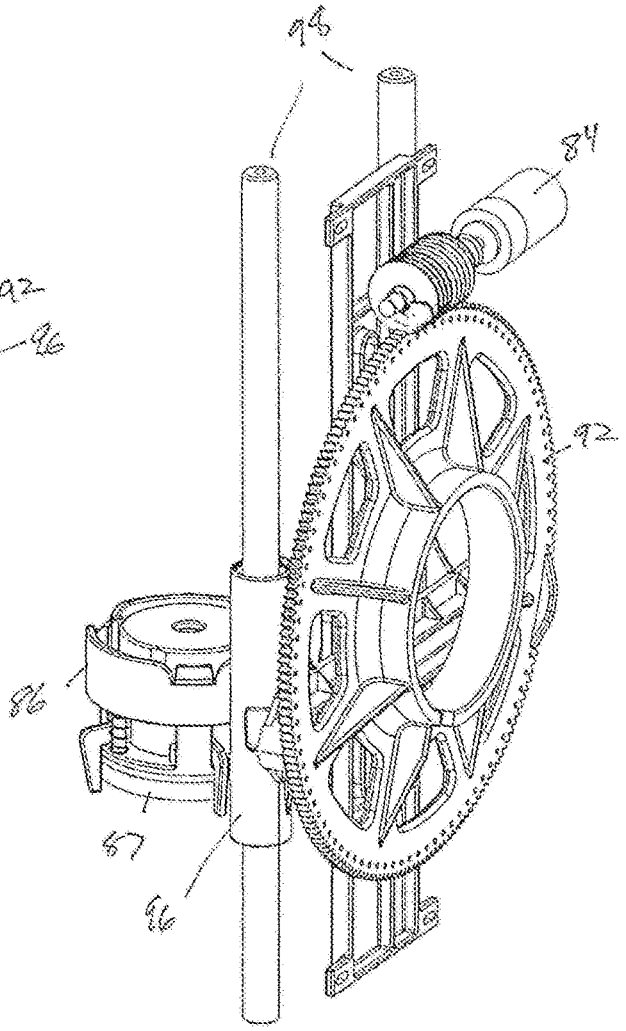
FIG. 24 shows a rear perspective view of several third zone components.
Figure 25:
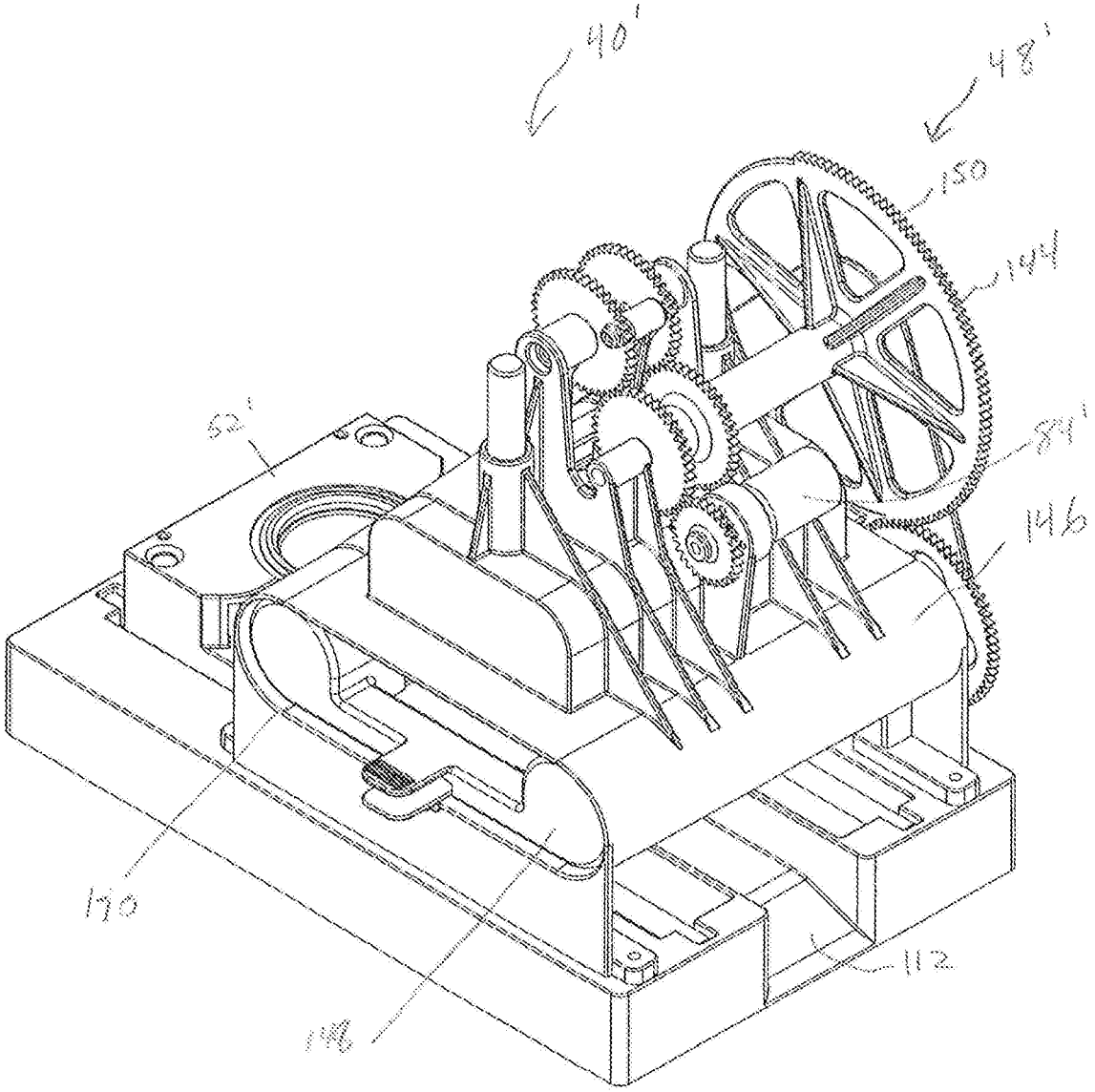
FIG. 25 shows a front perspective view of an alternative embodiment of the third zone.
Figure 26:
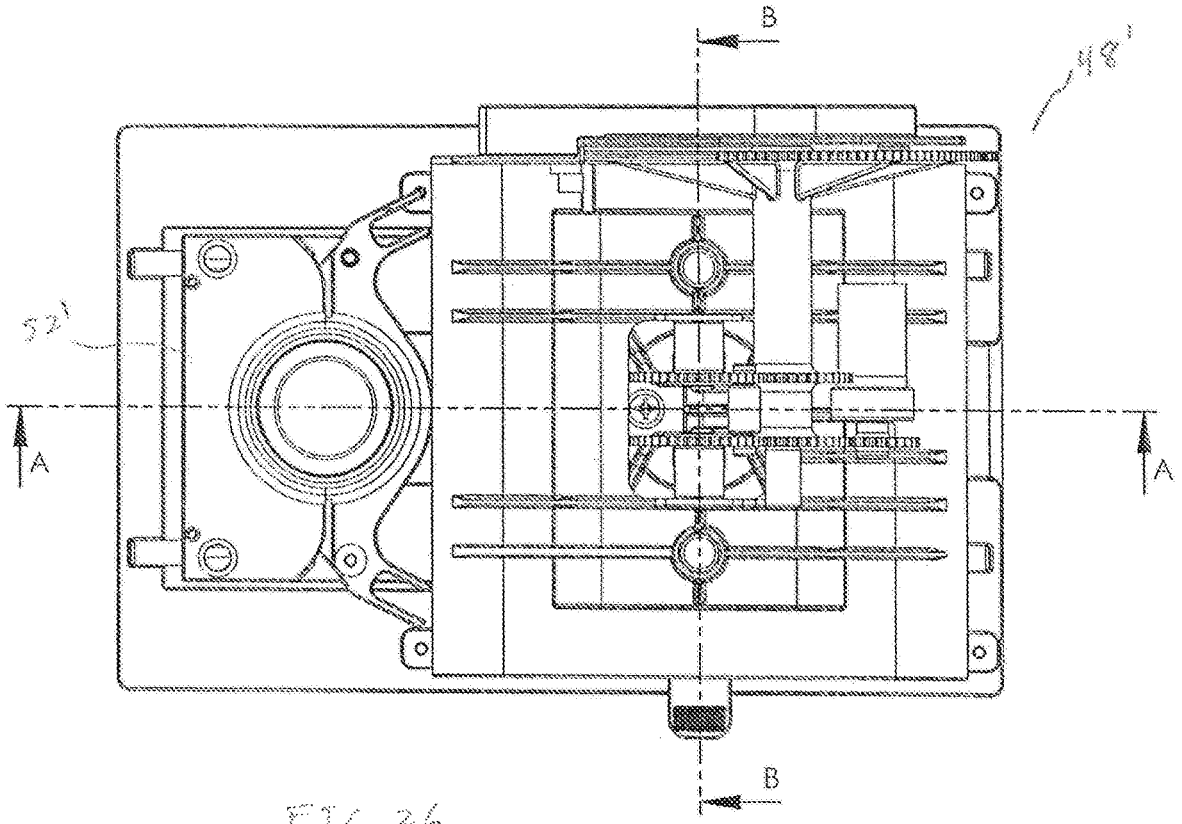
FIG. 26 shows a top view of the alternative embodiment of the third zone shown in FIG. 25.
Figure 27:
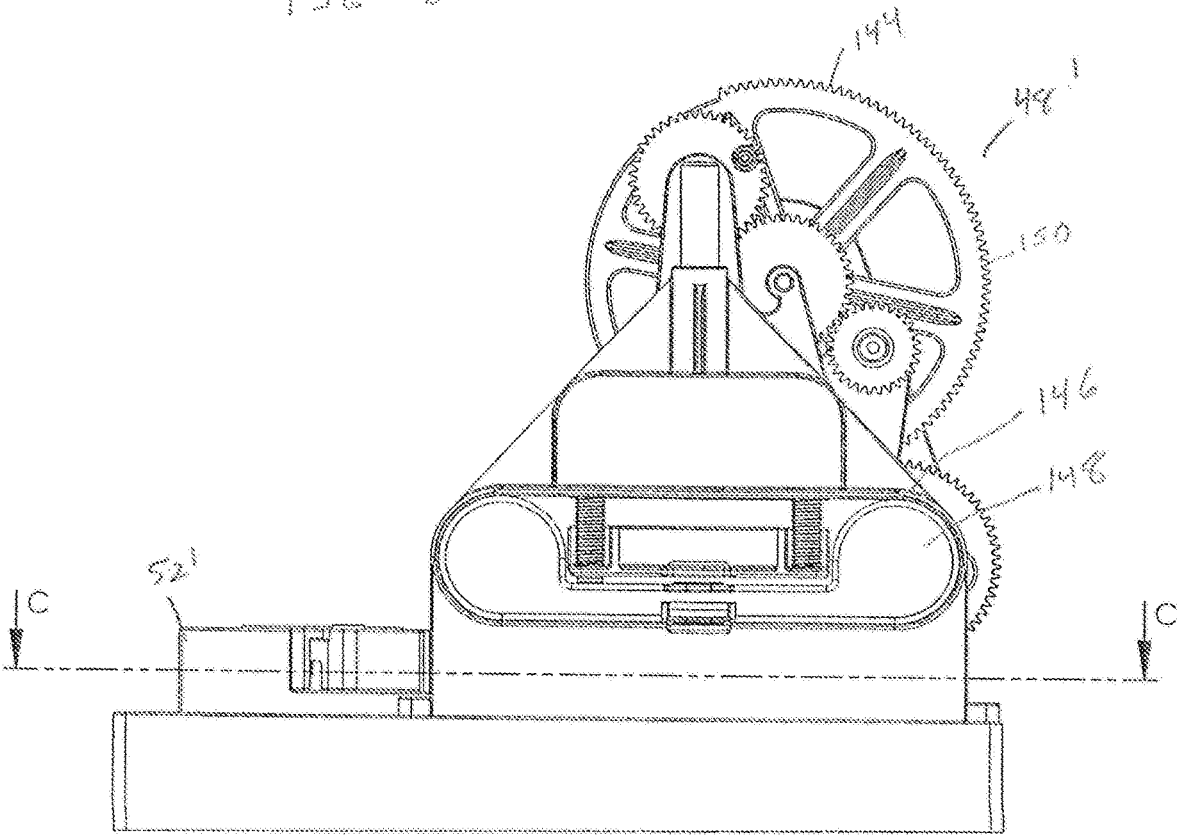
FIG. 27 shows a side view if the alternative embodiment of the third zone shown in FIG. 25.
Figure 28:
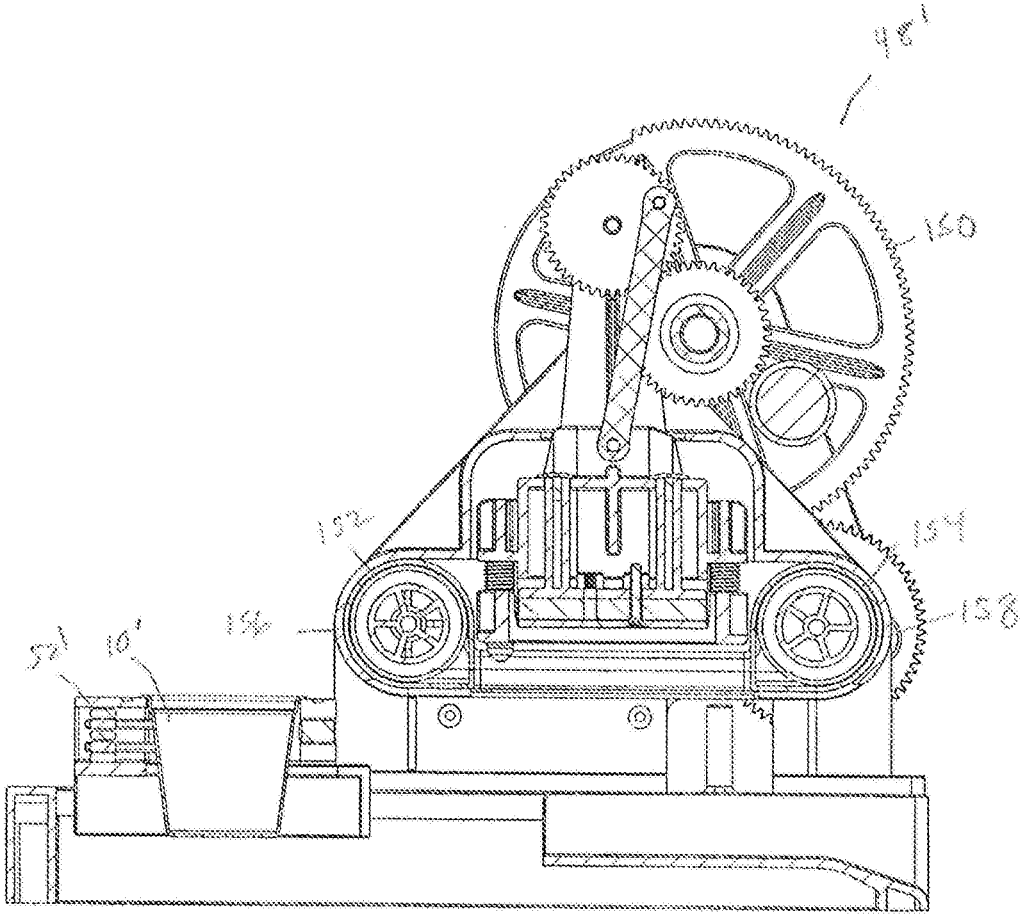
FIG. 28 shows a cross-sectional view through line A-A of FIG. 26.
Figure 29:
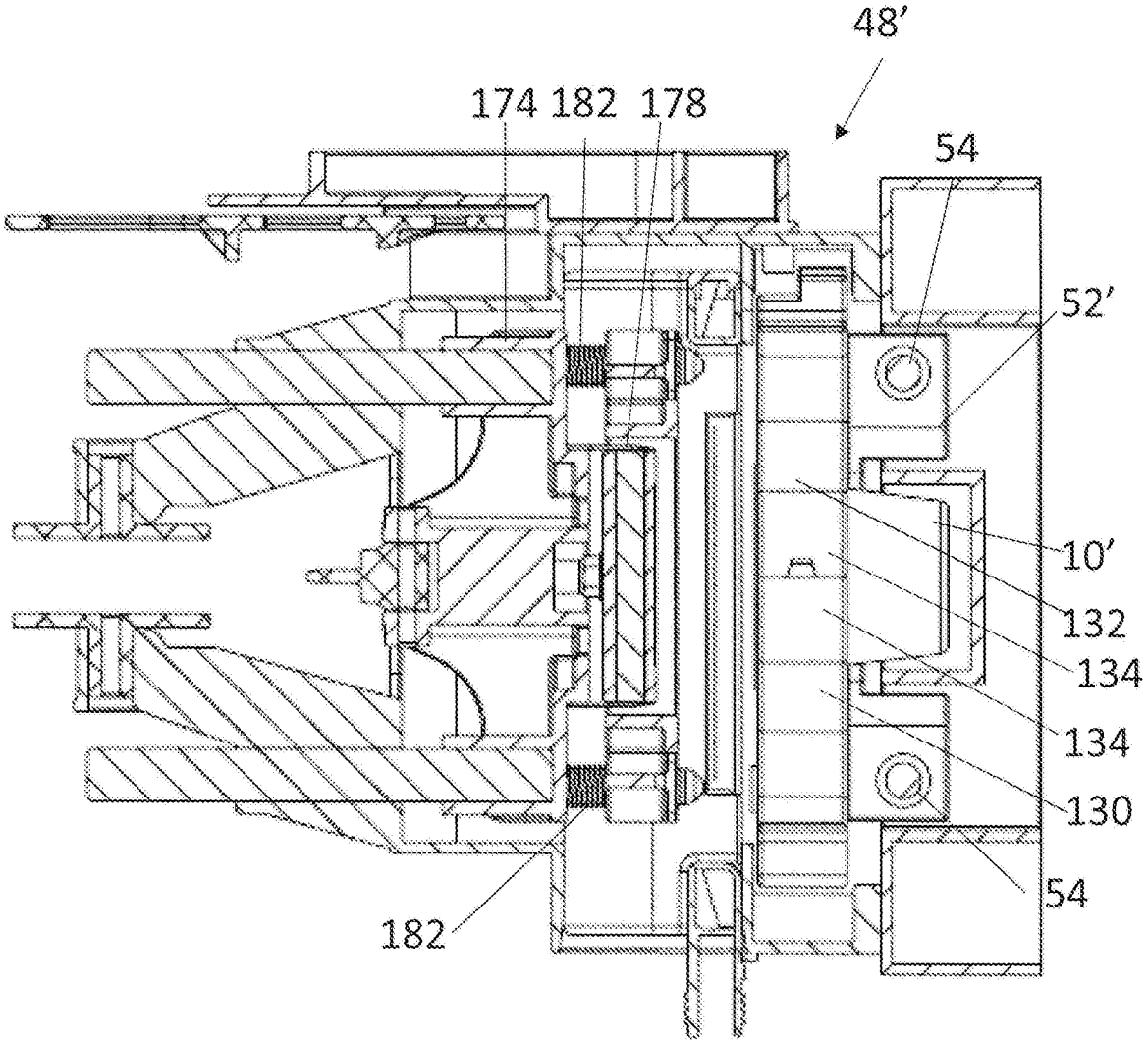
FIG. 29 shows a cross-sectional view through line B-B of FIG. 26.
Figure 30:
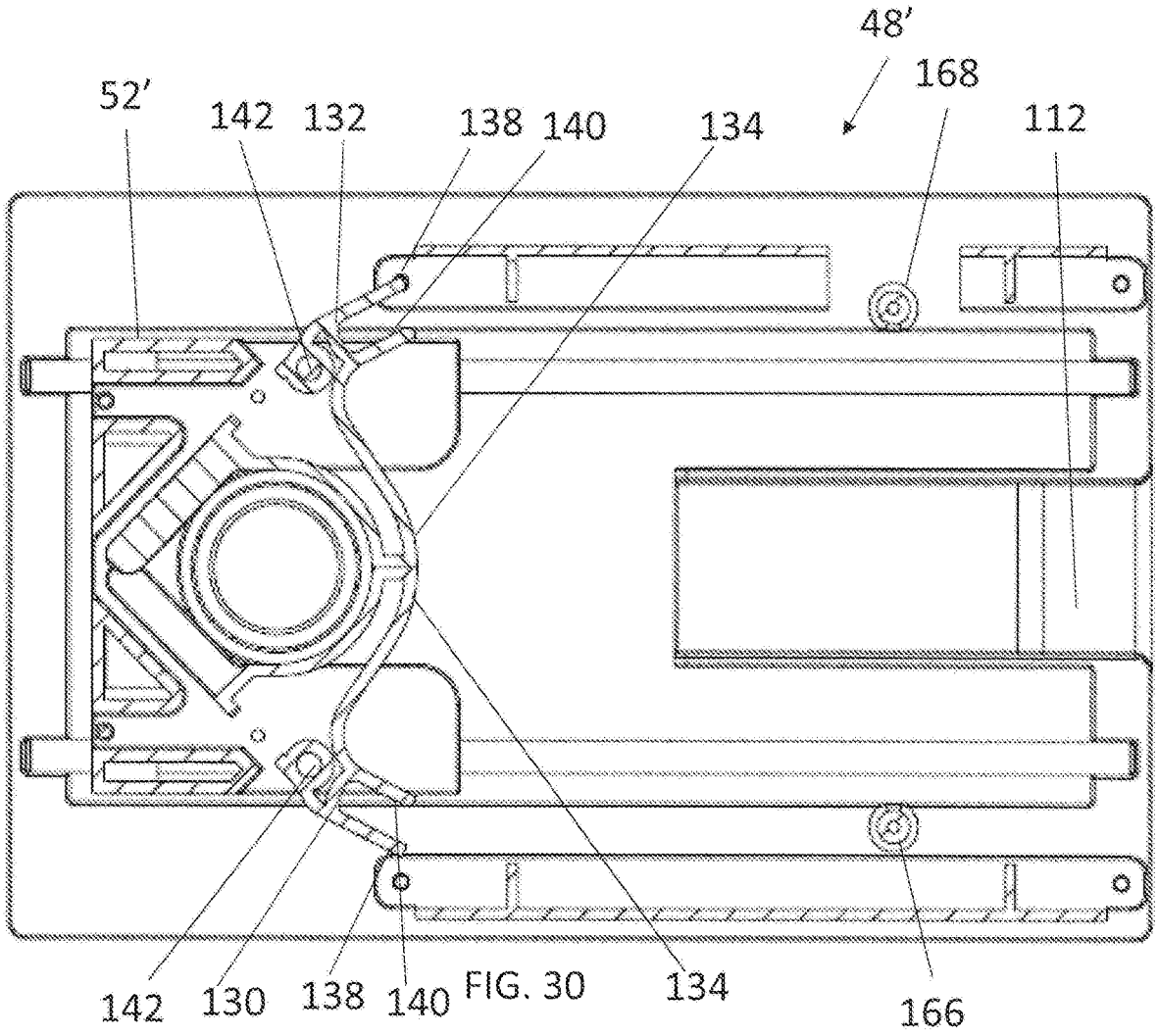
FIG. 30 shows a cross-sectional view through line C-C of FIG. 27.

FIGS. 10-15 show the operation of third zone 48. FIGS. 21-24 show several of the components of third zone 48. Once carriage 52 begins to head towards third zone 48, a signal is sent to third zone motor 84 to turn on. Carriage 52 signals third zone 48 by second zone micro switch 122 being activated when it leaves second zone 46 and when it touches another micro switch 124 under the third zone 48 (FIG. 19). A signal is sent to the vacuum pump motor 90 to turn on and create vacuum, and a signal is sent to turn on the heating element 87. Third zone 48 has a first third zone photo eye 118A and a second third zone photo eye 118B. First third zone photo eye 118A detects whether a container 10 is located in carriage 52 for being heat sealed. If there is no container 10, it sends a signal to motor 84 to stop, and lights a red LED. First third zone photo eye 118A also makes sure that the container 10 leaves carriage 52, and exits machine 40 properly. If it detects an object in its area still, it stops machine 40 from operating, and lights a red LED. The third zone motor 84 drives wheel gear 92. The knob 94 (FIG. 21) on the wheel gear 92 rotates 360 degrees around the wheel gear 92. Knob 94 is set into a channel 100 (FIG. 22) molded in the back of elevating carriage 96. This rotation of the wheel gear 92 with the knob 94 in the channel 100 causes the attached elevating carriage 96 to move up and down vertical guide rails 98 in one simple continuous 360 degree rotation. Coming through a hole 101 in the elevating carriage 96 is a shaft 104 attached to the heat seal vacuum head 86. The heat seal vacuum head 86 rotates on this shaft 104. The shaft 104 has a cup-shaped holder 106 on the end of it. Cup-shaped holder 106 has a knob 107 on one end that rides up and down a slot 102 in stationary bracket 99. As knob 107 moves along slot 102, cup-shaped holder 106 catches a C-shaped protrusion 108 (FIG. 21) on stationary bracket 99 that causes the heat seal vacuum head 86 to flip around vertically as it travels up and down. This rotating heat seal vacuum head 86 is what moves vertically up and down in third zone 48. The heat seal vacuum head 86 (FIG. 10) rotates upward to pick a lid 18 from the lid dispenser 82 above (FIG. 9), and rotates back down to the filled container 10 awaiting in the carriage below 52 (FIG. 11). While holding the lid 18, the heat seal vacuum head 86 presses downwards onto the top of the container 10 below, applies pressure with a spring carriage 110 in the heat seal vacuum head 86, and with the heating element 87 in the heat seal vacuum head 86, heat seals the lid 18 to the rim of the container 10 (FIG. 12). After a brief period of waiting for the heat seal to finish, the vacuum still on, the heat seal vacuum head 86 lifts the container 10 out of the carriage below 52 (FIG. 13), turns at a 45 degree angle (FIG. 14), and releases the container 10 by turning off the vacuum (FIG. 15). The vacuum is turned off by second third zone photo eye 118B (FIG. 16) sending a signal to turn off the vacuum pump motor 90. This signal is sent by having a notch in the back of wheel 92. The notch rotates with the turning of wheel 92, and passes by second third zone photo eye 118B, which gives off the signal at exactly the same spot every time. The container 10 falls onto a ramp 112 below, and slides out of the machine 40 onto a countertop, finished. After a container 10 is completed, the machine receives a signal to begin the process again, and carriage 52 runs back to first zone 44 to start over. Control can be accomplished by a processor and software instructions, hardwired logic, and mechanical control mechanisms. Various sensors and actuators can be used as is well known in the mechanical arts to detect the mechanism position and to generate the required signals for control.

Figure 38:
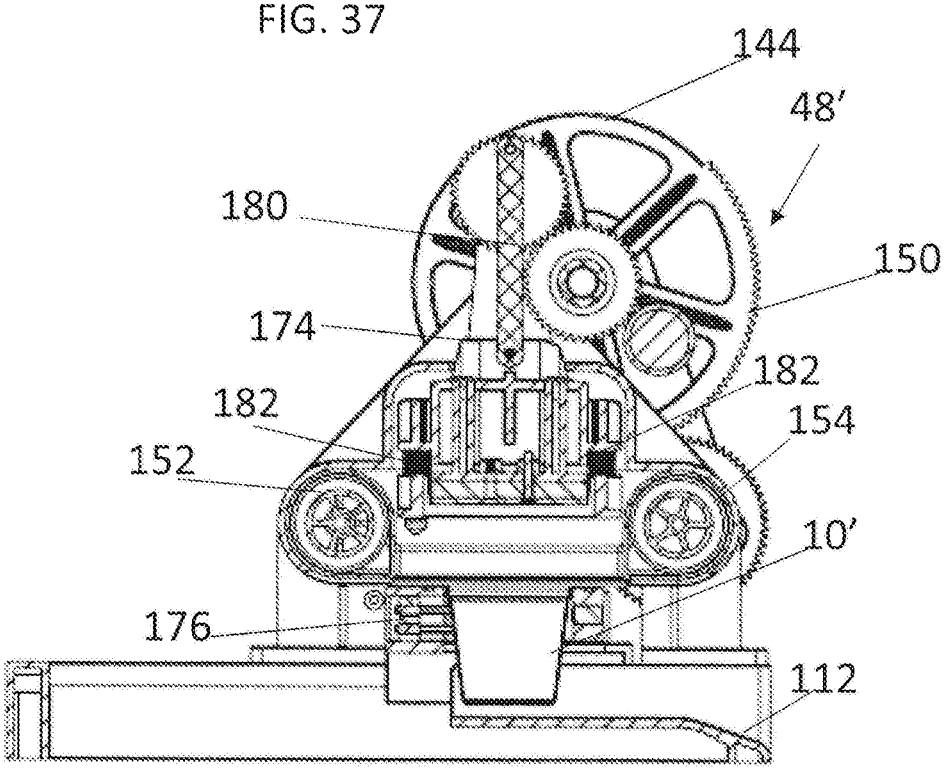
FIG. 38 shows a cross-sectional view through line A-A of FIG. 37.
Figure 39:
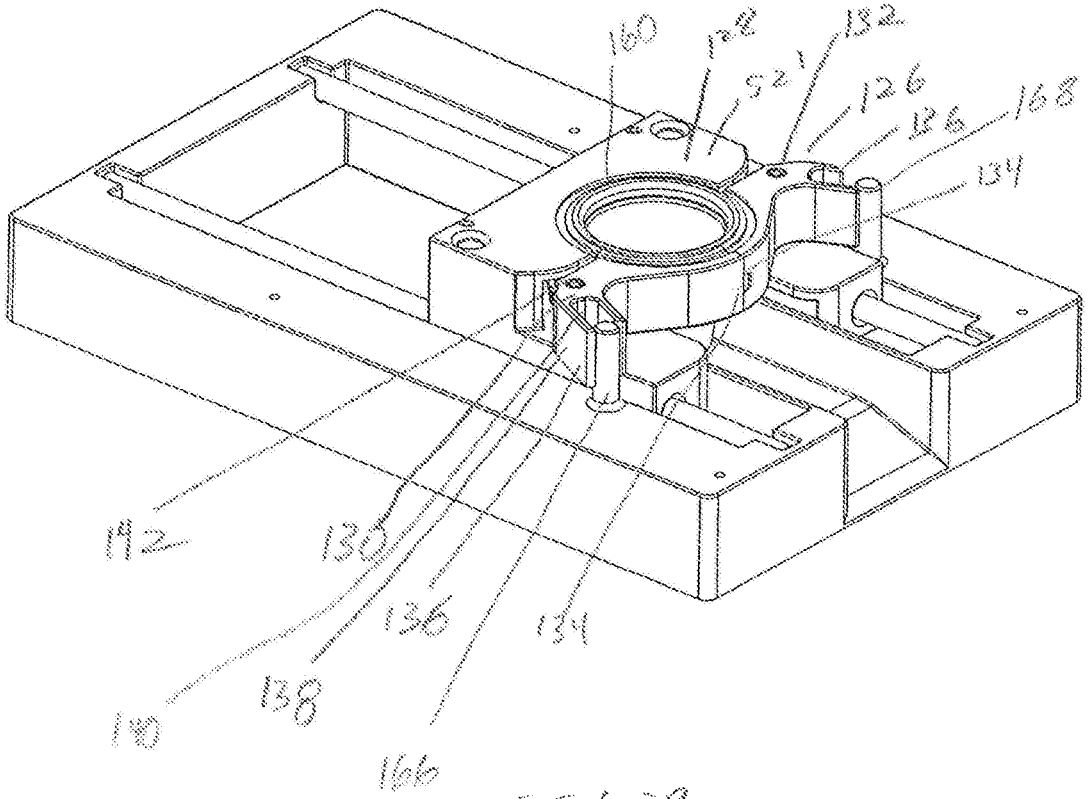
FIG. 39 shows a top perspective view of select components of the alternative embodiment of the third zone including the carriage in a closed position.
Figure 40:
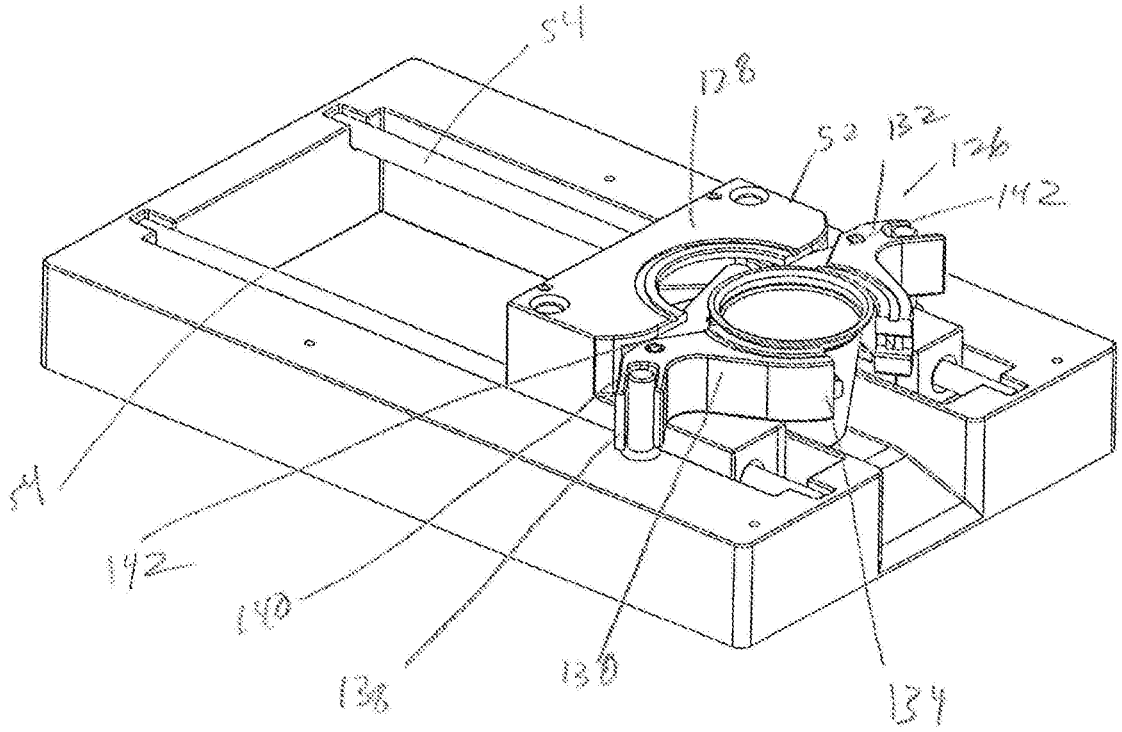
FIG. 40 shows a top perspective view of select components of the alternative embodiment of the third zone including the carriage in a partially open position.
Figure 41:
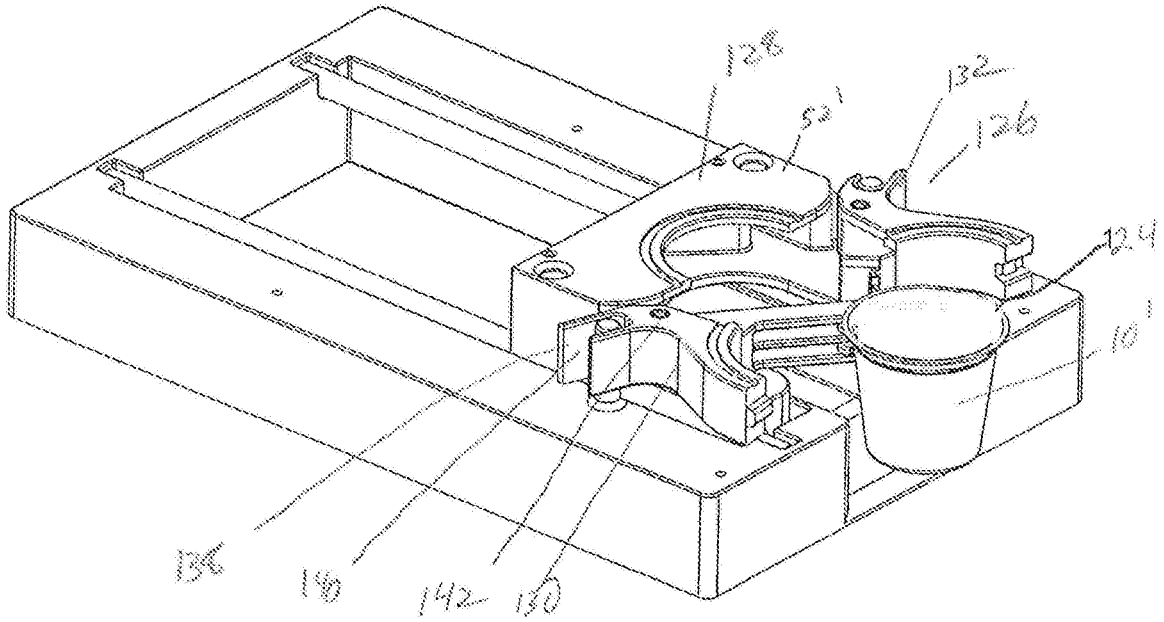
FIG. 41 shows a top perspective view of select components of the alternative embodiment of the third zone including the carriage in an open ejection position.
Figure 42:
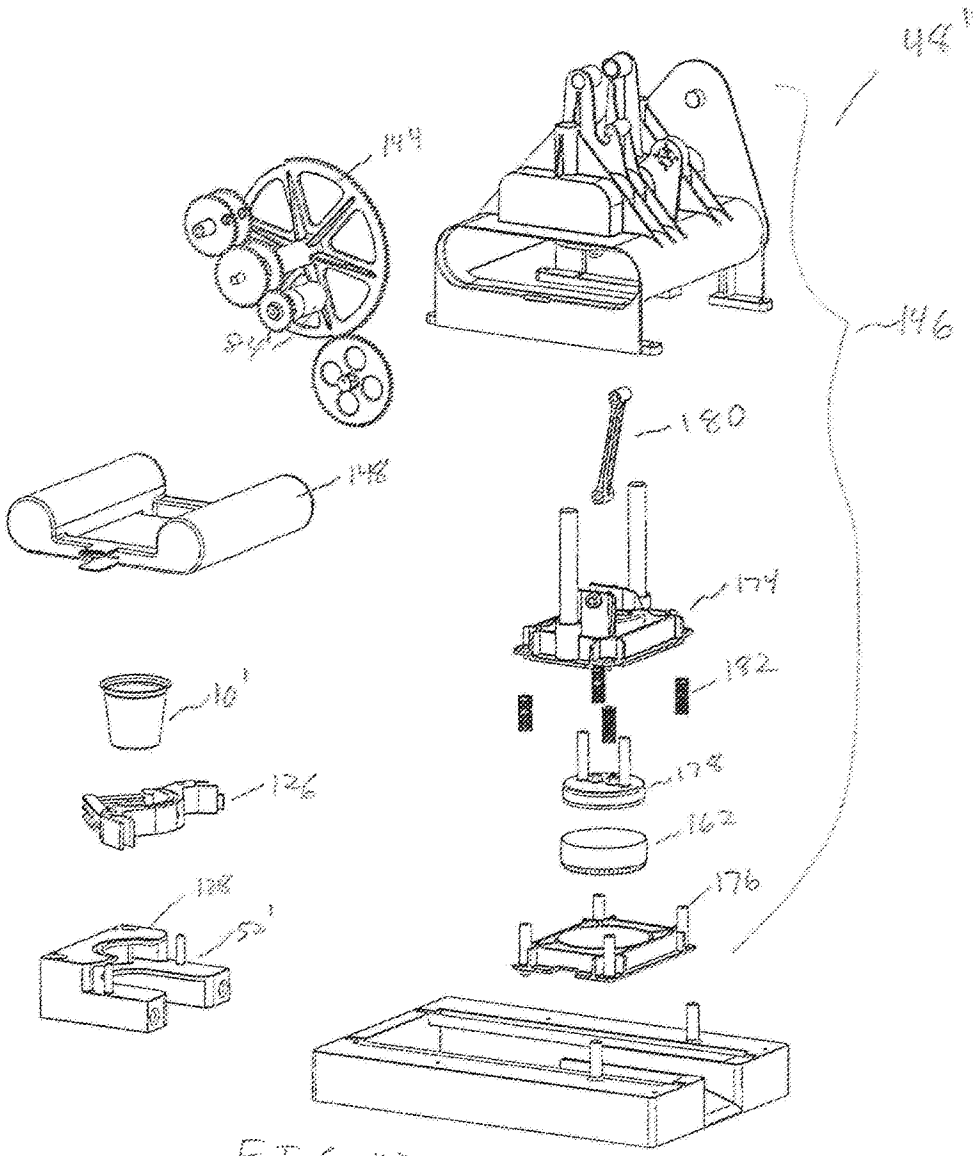
FIG. 42 shows an exploded view of components of the alternative embodiment of the third zone.

FIGS. 25-42 show an alternative embodiment of the machine 40' for automated filling of containers 10'. If not otherwise stated herein, it may be assumed that all components and/or processes described below may, if appropriate, be considered to be interchangeable with similar components and/or processes disclosed previously in the specification, unless an express indication is made to the contrary, wherein like reference numbers indicate like elements described and shown with reference to the previous embodiment, wherein modified elements are designated by prime. Machine 40' differs from machine 40 primarily in the design of carriage 52' and the third zone 48'. The first zone 44 and the second zone 46 components are the same. The containers 10' used in this embodiment differ from the ones used in the previous embodiment, in that containers 10' are sealed with a lid sized piece of film 124' instead of a lid 18 from a lid dispenser 82. With reference to FIGS. 5-42, the this embodiment has a first zone 44 for dispensing a container 10' from a stack of containers 58, a second zone 46 for filling the container 10' with a beverage substrate and a third zone 48' (FIGS. 25-42) for sealing the container 10' and dispensing a filled container 10'. Carriage 52' is disposed beneath the three zones 44, 46 and 48' and has a motor 50 for moving carriage 52' in a reciprocating motion on a pair of rails 54 in order to transfer a container 10' between the zones 44, 46 and 48'. Carriage 52' differs from carriage 52 in that it includes a hinged ejector mechanism 126 (FIGS. 39-41). Specifically, carriage 52' includes a seat member 128 opposite the hinged ejector mechanism 126. Hinged ejector mechanism 126 includes a first hinged member 130 and a second hinged member 132 each having an inner end 134 which when the hinged ejector mechanism 126 is closed (FIG. 39) is disposed adjacent the inner end 134 of the other hinged member 130, 132. The outer end 136 of each of the first and second hinged members 130, 132 includes a finger 138 having a groove 140. Each of the first and second hinged members 130, 132 further includes a pivot 142 intermediate the inner end 134 and the outer end 136 to open and close the first and second hinged members 130, 132. A container 10' is held between the seat member 128 and the hinged ejector mechanism 126 until the first and second hinged members 130, 132 are rotated (FIGS. 40, 41) about the pivots 142 upon opening of the hinged ejector mechanism 126.

The third zone 48' includes a film advance gear 144, a sealing mechanism 146 and a film cartridge 148. The film advance gear 144 has geared teeth 150 on only part, for example substantially 180°, of it that raises and lowers sealing mechanism 146. Heat sealing mechanism 146 includes a housing 172, a top plate 174 with guiding and supporting rails and a bottom plate 176. A heat plate for sealing 180 and a circular blade 162 disposed in between the top plate 74 and the bottom plate 176. The heat sealing mechanism further comprises a piston arm 180 and springs 182. Piston arm 180 helps drive the top plate down and outs pressure on springs 182 to help create a strong seal on the film and cup 10'. The film cartridge 148 has first and second spools 152, 154 (FIG. 28) at each of first and second ends 156,158 thereof about which film 124 is wound around for advancement of the film 124 from the first end 156 to the second end 158. The film 124 is for sealing the containers 10' and for creating a lid on top. The position of the teeth 150 on the film advance gear 144 causes the film 124 to advance in the film cartridge 148 only while the heat sealing mechanism 146 is in the raised, non-sealing position. The film advance gear 144 causes the film 124 to advance in the film cartridge 148 by engaging with another gear (not shown) on the inside of the film cartridge 148.

The third zone 48' further includes ejector actuators such as first and second ejector pins 166, 168 (FIGS. 39-41) to eject the container 10' from the carriage 52'. As carriage 52' is advanced along the rails 54 first and second ejector pins 166, 168 enter grooves 140. As the carriage 52' continues to advance, the fingers 138 rotate forward, pushing against the container 10', and sending it outside of the machine 40'.

To operate machine 40', a user places a vertical stack 58 of containers 10' into the container loading channel 56 of the first zone 44, loads the beverage substrate into beverage substrate hopper 70 in the second zone 46, and places a film cartridge 148 into a slot 170 in the heat sealing mechanism 146. The user then selects the settings of what is being made by moving a three point switch for selecting, for example, "Coffee," "Cocoa," or "Tea," or and the quantity of beverage substrate to put in each container 10 by moving a three point switch for selecting, for example, "Light," "Regular," or "Strong." Next, the user powers on the machine 40' by turning on the power switch. This causes motor 50 to return carriage 52' to the first zone 44 where it is sensed by microswitch 120 and photo eye 114 checks for an obstructing presence. If there is an obstructing container, carriage 52' moves to the third zone 48' and a red Error Notification LED is lit, prompting the user to remove the obstructing container. If no container 10' is present, a signal is sent to second zone motor 76 that runs the gears 66, 68 holding the stack 58 of containers 10' the start signal for dropping a container 10'. Once the carriage 52' is positioned directly under the first zone 44, the first zone motor 62 spinning the ring gear 66 that spins the cylindrical gears 68 begins to pulse. This pulsing moves the containers 10' downward until one is released from the channel 56 in cylindrical gear 68 holding the container 10'. As soon as a container 10' has dropped, the photo eye 114 beneath the first zone 44 senses the change in distance moved by the bottom of the container 10', and stops the first zone 44 motor 62 from pulsing immediately. Once the signal from the photo eye 114 under the first zone 44 has been activated, the motor 50 for the carriage 52' turns on, and sends the carriage 52' to the second zone 46.

Once the carriage 52' trips micro switch 122 under the second zone 46, the motor 50 for carriage 52' receives a signal to stop, and the motor 76 for the second zone 46 that runs the auger 80 begins to spin. A time delay is built into the program for the auger's motor 76 to allow for a priming of the auger housing 78. As soon as beverage substrate begins to exit the lower dispensing end 74, photo eye 116 picks up the break in its signal, and begins to run an algorithm based on the settings selected earlier. Once the timer in the algorithm reaches its end, it signals the auger motor 76 to stop, thereby stopping the filling of the container 10. At this point it also sends a signal to the carriage motor 50 to turn on, and to send it to the third zone 48'.

Figure 31:
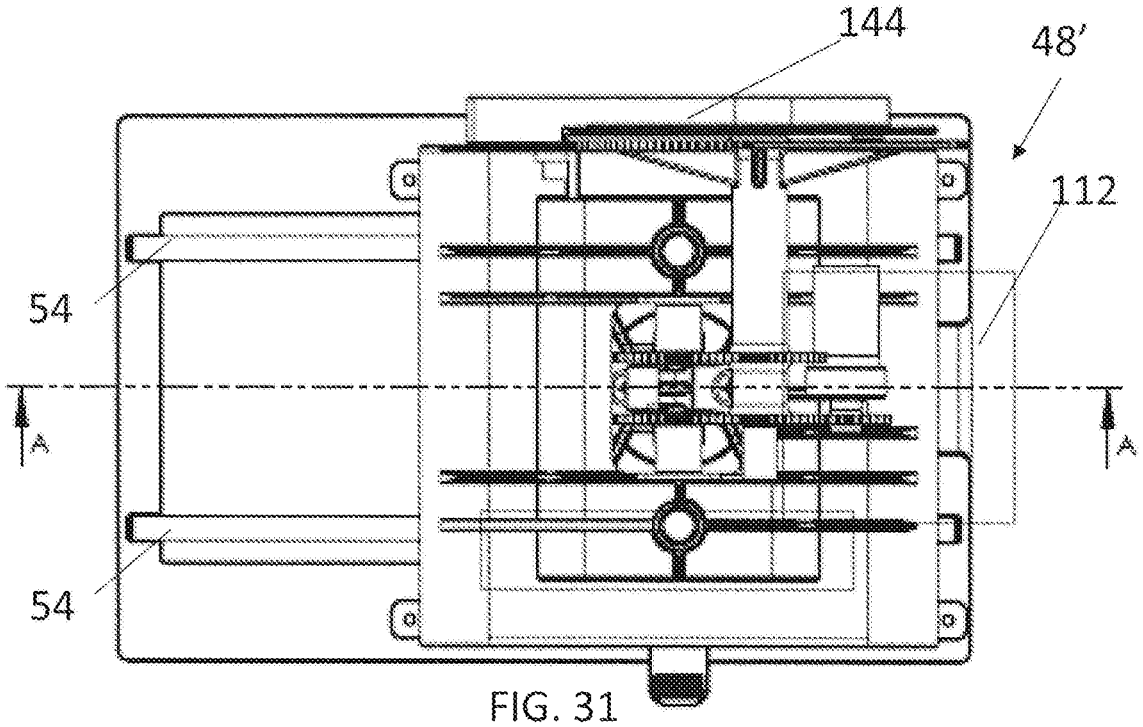
FIG. 31 shows a top view if the alternative embodiment of the third zone in a clamp position.
Figure 32:
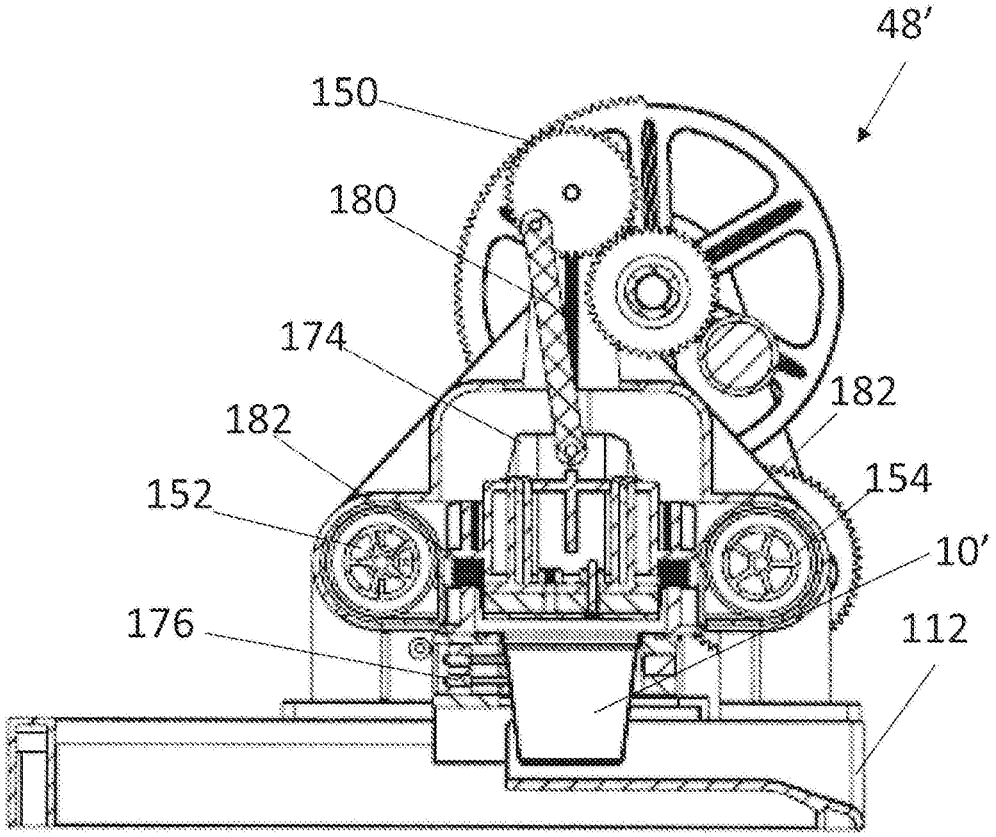
FIG. 32 shows a cross-sectional view through line A-A of FIG. 31.
Figure 33:
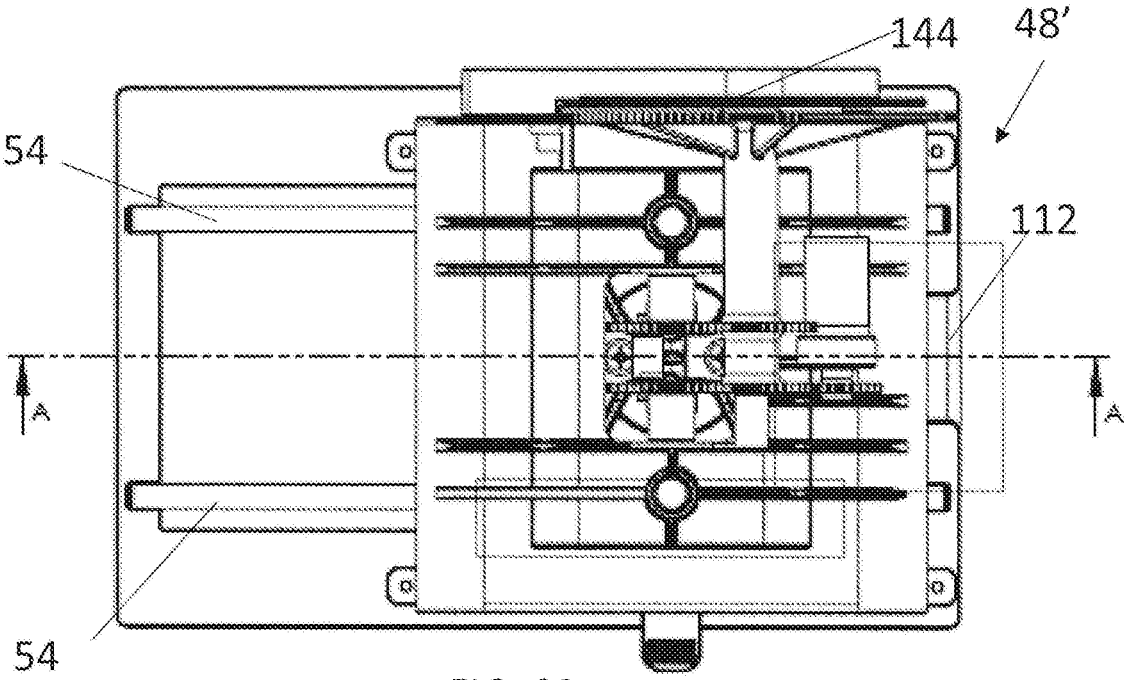
FIG. 33 shows a top view of the alternative embodiment of the third zone in a seal position.
Figure 34:
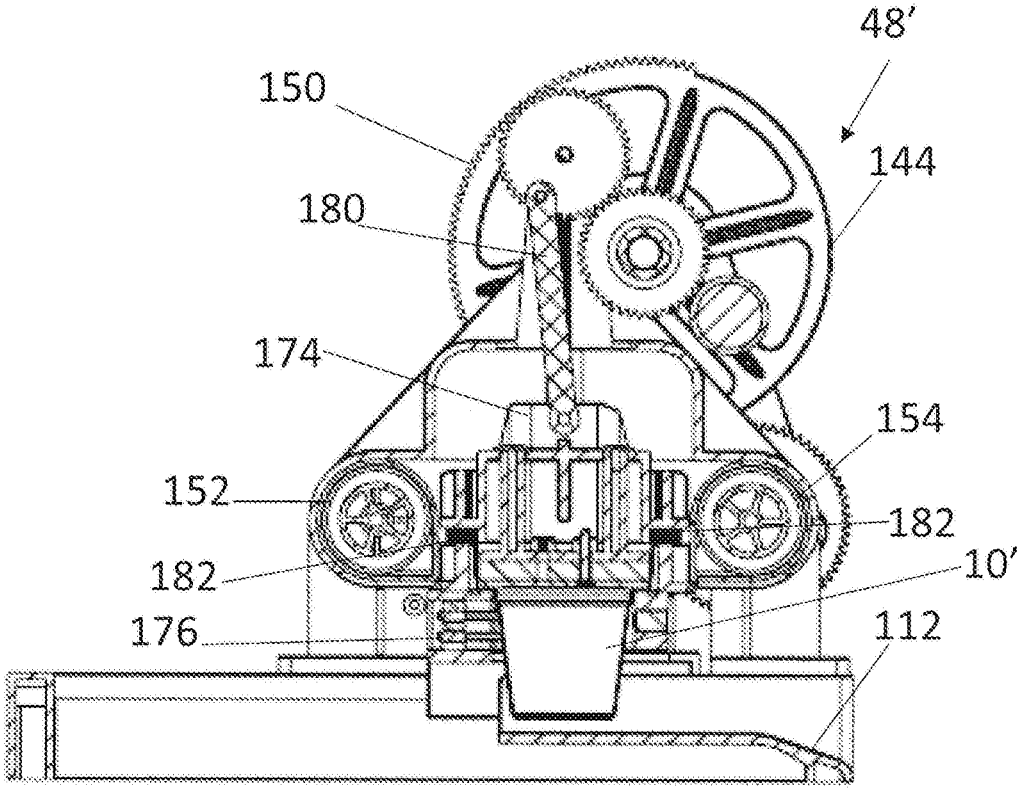
FIG. 34 shows a cross-sectional view through line A-A of FIG. 33.
Figure 35:
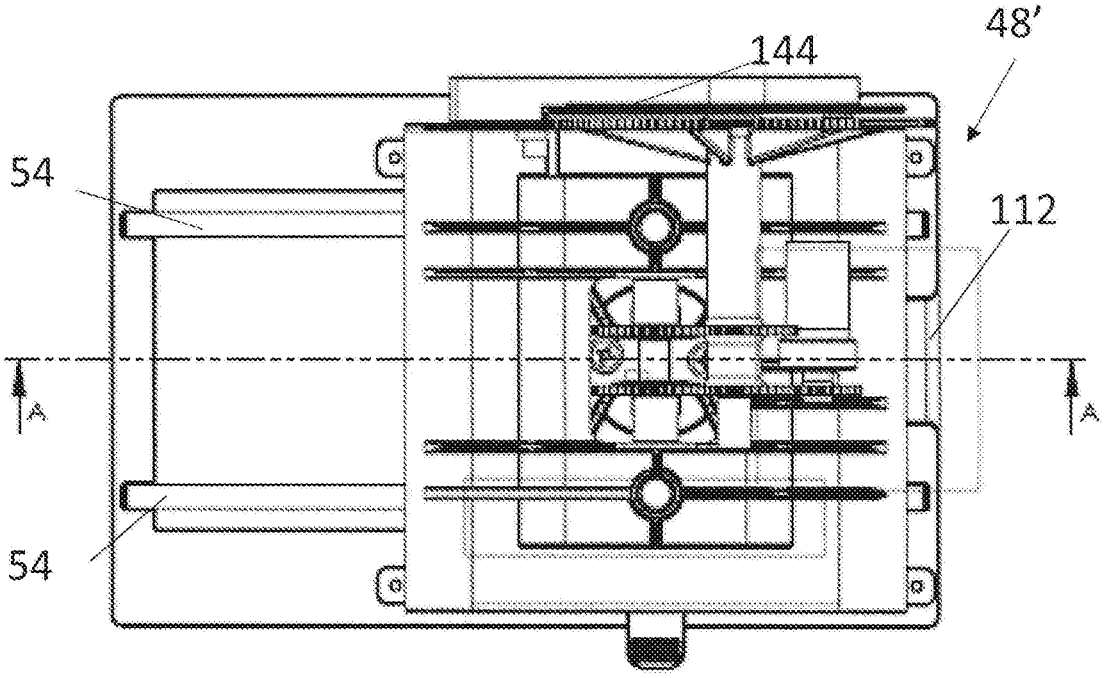
FIG. 35 shows a top view if the alternative embodiment of the third zone in a cut position.
Figure 36:
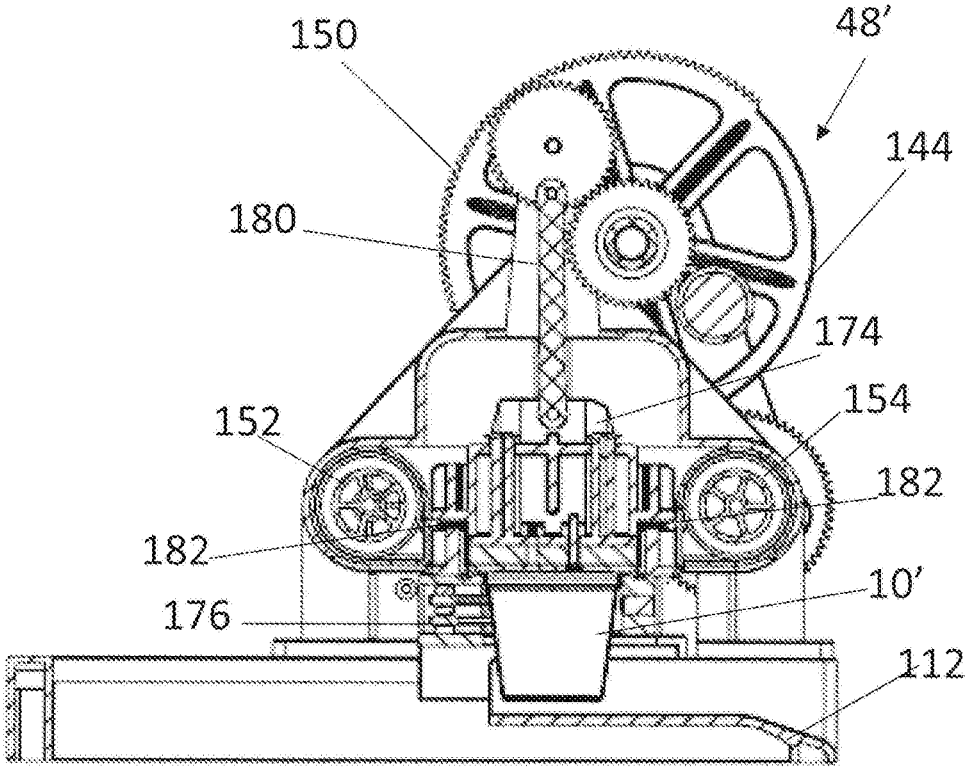
FIG. 36 shows a cross-sectional view through line A-A of FIG. 35.
Figure 37:
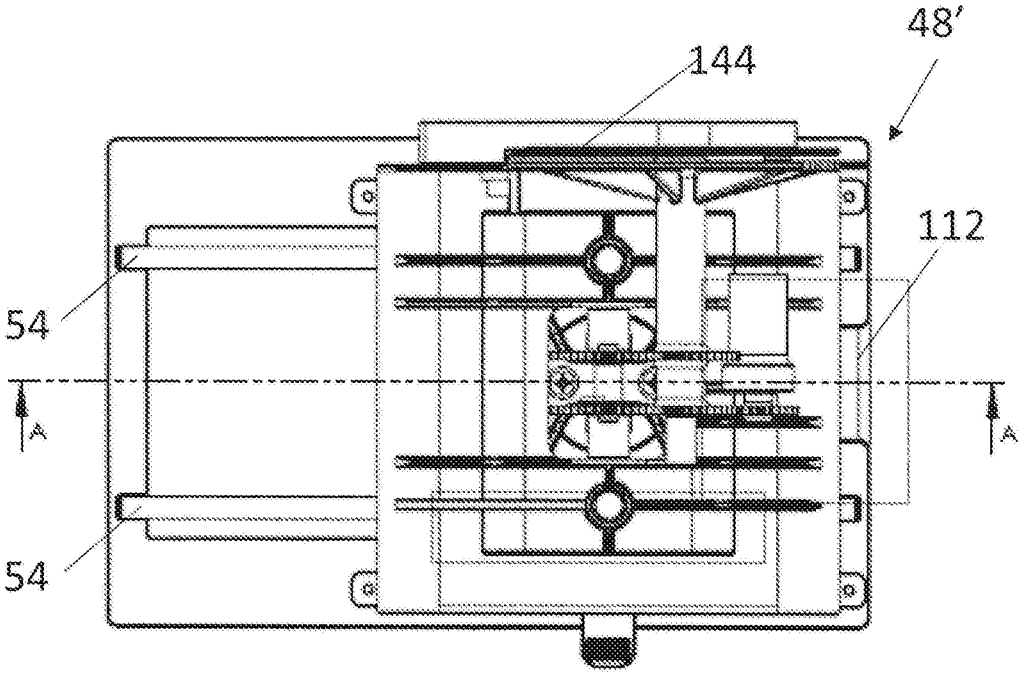
FIG. 37 shows a top view if the alternative embodiment of the third zone in an up position.

Once the carriage 52' arrives in the third zone 48', a signal is sent to the third zone's motor 84' to turn on. Motor 84' drives a series of gears that operate the heat sealing mechanism 146 and the film advance gear 144. A signal is sent to the heat sealing mechanism 146 to turn on and maintain a specific temperature. The heat sealing mechanism 146 lowers to the film cartridge 148 below by the series of gears driven by the film advance gear 144. A multi-step process happens during the seal. First, a ridge 160 on the cup carriage 52' pushes against the film 124 and heat sealing mechanism 146 during the first lowering of the heat sealing mechanism 146 (FIGS. 31, 32). This holds a lid sized piece of film 124 in place. After it is held, the second movement happens where the heat sealing mechanism 146 lowers by the series of gears driven by the film advance gear 144 and makes contact to seal the film to the rim 36 of the container 10' (FIGS. 33, 34). The final process is circular blade 162 that comes down and cuts out a hole in the film around the rim 36 of the container 10'. Circular blade 162 is also driven by the series of gears driven by the film advance gear 144 (FIGS. 35, 36) finishing and releasing the container 10' from the film 124 and film cartridge 148. FIGS. 37 and 38 show the return of the cammed piston arm which returns components operated by the series of gears back to the start, and moves the film 124 in the film cartridge 148 forward for a fresh uncut spot on the film 124. To eject the container 10, the carriage 52' is hinged and opens up after arriving at first and second ejector pins 166, 168 along the rails 54 of the machine 40'. As one end of the carriage 52' opens, fingers 138 rotate forward, pushing against the container 10', and sending it outside of the machine 40'.

Nothing in the above description is meant to limit the invention to any specific materials, geometry, or orientation of elements. Many part/orientation substitutions are contemplated within the scope of the invention and will be apparent to those skilled in the art. The embodiments described herein were presented by way of example only and should not be used to limit the scope of the invention.

Although the invention has been described in terms of particular embodiments in this application, one of ordinary skill in the art, in light of the teachings herein, can generate additional embodiments and modifications without departing from the spirit of, or exceeding the scope of, the described invention. Accordingly, it is understood that the drawings and the descriptions herein are proffered only to facilitate comprehension of the invention and should not be construed to limit the scope thereof.

What is claimed is:

1. A container for the preparation of a beverage comprising:

an outer cup having a base, a frustoconically shaped sidewall, and an opening opposite the base;

an inner cup nesting inside the outer cup; the inner cup having a bottom opening, a frustoconically shaped sidewall, and a top opening opposite the bottom opening; and a filter disposed between the sidewall of the outer cup and the sidewall of the inner cup and covering the bottom opening of the inner cup.

2. The container of claim 1, wherein the sidewall of the outer cup includes a radially outwardly protruding lip surrounding the opening of the outer cup, and wherein the sidewall of the inner cup includes a radially outwardly protruding lip surrounding the top opening of the inner cup.

3. The container of claim 2, wherein the lip of the outer cup and the lip of the inner cup are each have a folded over and flattened configuration, and wherein the lip of the outer cup and the lip of the inner cup are heat sealed together.

4. The container of claim 3 further comprising a rim on the periphery of the base of the outer cup.

5. The container of claim 4, wherein the rim has a folded over and flattened configuration and is heat sealed to the base.

6. The container of claim 5, further comprising a lid disposed on the radially outwardly protruding lip of the inner cup.

7. The container of claim 6, wherein the lid is heat sealed to the radially outwardly protruding lip of the inner cup.

8. The container of claim 7, wherein the inner cup and the outer cup comprise compostable, heat sealable paper, wherein the filter comprises compostable paper, and wherein the lid comprises one of compostable, heat sealable paper and compostable, heat sealable film.

* * * * *